US009642438B2

(12) United States Patent
Choi

(10) Patent No.: US 9,642,438 B2
(45) Date of Patent: May 9, 2017

(54) COSMETIC CONTAINER

(71) Applicant: Man Su Choi, Ansan-si (KR)

(72) Inventor: Man Su Choi, Ansan-si (KR)

( * ) Notice: Subject to any disclaimer, the term of this patent is extended or adjusted under 35 U.S.C. 154(b) by 351 days.

(21) Appl. No.: 14/618,600

(22) Filed: Feb. 10, 2015

(65) Prior Publication Data

US 2015/0359312 A1 Dec. 17, 2015

(30) Foreign Application Priority Data

May 23, 2014 (KR) ..... 10-2014-0062386
Aug. 29, 2014 (KR) ..... 10-2014-0114282
Nov. 20, 2014 (KR) ..... 10-2014-0162419

(51) Int. Cl.

| | |
|---|---|
| ***A45D 40/24*** | (2006.01) |
| ***B05C 17/01*** | (2006.01) |
| ***A46B 11/04*** | (2006.01) |
| ***A61M 37/00*** | (2006.01) |
| ***A46B 11/00*** | (2006.01) |
| ***B67D 7/06*** | (2010.01) |
| ***B43K 7/02*** | (2006.01) |
| ***A45D 34/04*** | (2006.01) |

(52) U.S. Cl.

CPC ..... *A45D 34/043* (2013.01)

(58) Field of Classification Search

CPC ..... A45D 34/043; B05C 17/10; B65D 51/32; A61H 7/005; A46B 11/002; A61M 5/315
USPC ..... 401/272, 172, 151, 109, 273, 278, 150, 401/274, 155
See application file for complete search history.

(56) References Cited

U.S. PATENT DOCUMENTS 1,978,757 A * 10/1934 O'Keefe ..... A46B 11/0017 401/150
2,302,062 A * 11/1942 Schweyer ..... B43K 7/02 401/150
2,872,694 A * 2/1959 Hopkins ..... A45D 34/043 222/443
4,116,570 A * 9/1978 Parenti ..... A46B 11/0024 401/155
4,773,785 A * 9/1988 Katz ..... A46B 11/0013 401/101
5,088,850 A * 2/1992 Taichman ..... A46B 11/002 401/176

(Continued)

*Primary Examiner* — David Walczak
*Assistant Examiner* — Thomas M Abebe
(74) *Attorney, Agent, or Firm* — Stein IP, LLC

(57) ABSTRACT

Disclosed is a cosmetic container. The cosmetic container includes: a main body, in which a liquid material is stored; a rod insertion container inserted into the main body and provided with one or more liquid inflow holes, through which the liquid material stored in the main body flows in; a forcibly inserting means for drawing out a brush to the outside; a brush supporting means including a brush support piece mounted with a brush; an elastic member, and a cap. According to the present invention, it is possible to prevent a cosmetic liquid from being hardened inside a container by securing a sealing structure of the cosmetic container. Further, according to the present invention, it is possible to stably keep a cosmetic container, thereby extending a lifespan of a product. Further, according to the present invention, it is possible to enable a user to more conveniently and easily wear nail polish compared to an existing method in using a cosmetic container.

20 Claims, 26 Drawing Sheets

(56) References Cited

U.S. PATENT DOCUMENTS

| | | | | | |
|---|---|---|---|---|---|
| 5,569,193 | A * | 10/1996 | Hofstetter | A61M 5/31596 | 604/89 |
| 5,871,297 | A * | 2/1999 | Rogers | A46B 11/002 | 401/146 |
| 5,971,953 | A * | 10/1999 | Bachynsky | A61M 5/284 | 604/181 |
| 6,688,796 | B1 * | 2/2004 | Liu | A45D 34/042 | 401/172 |
| 6,749,356 | B1 * | 6/2004 | Mead | B05C 17/0136 | 401/176 |
| 8,092,108 | B2 * | 1/2012 | Bainbridge | B05C 17/00516 | 401/171 |
| 8,641,661 | B2 * | 2/2014 | Delmotte | A61J 1/2096 | 604/416 |
| 8,727,652 | B2 * | 5/2014 | Jimenez | A46B 11/0024 | 401/172 |
| 8,985,399 | B2 * | 3/2015 | Gyakushi | B65D 35/24 | 222/183 |
| 2006/0258977 | A1 * | 11/2006 | Lee | A61M 5/31596 | 604/82 |
| 2016/0309881 | A1 * | 10/2016 | Liu | A45D 40/24 | |

* cited by examiner

COSMETIC CONTAINER

CROSS-REFERENCE TO RELATED APPLICATIONS

This application claims priority to and the benefit of Korean Patent Application Nos. 10-2014-0062386, 10-2014-0114282 and 10-2014-0162419 filed in the Korean Intellectual Property Office on May 23, 2014, Aug. 29, 2014 and Nov. 20, 2014 respectively, the entire contents of which are incorporated herein by reference.

BACKGROUND OF THE INVENTION

1. Field of the Invention

The present invention relates to a cosmetic container.

2. Description of the Related Art

In a nail polish container in the related art, a bottle having a bottleneck provided with a screwed part stores nail polish, and a support rod is provided at a center of a knob serving as a stopper, which is screwed onto the screw part of the bottleneck. Further, a brush is attached to a lower end of the support rod. The general nail polish container including the aforementioned configuration is used in such a manner that a user opens a bottle, in which the nail polish is stored, by rotating the knob, and then puts the brush immersed into the nail polish onto a nail and wears the nail polish.

However, in the nail polish container in the related art, when a user puts nail polish on a nail or a toenail desired to be manicured, the user needs to frequently immerse in the nail polish, so that there is inconvenience in that the user needs to repeatedly put the brush into bottle and take out the brush from the bottle.

Further, when the nail polish bottle is located beside a user while the user wears nail polish, the bottle may fall down due to carelessness of the user, and when the user puts the brush into the bottle and rotates the knob in the state where the nail polish is not dried after finishing the manicure, a flow is generated in the nail polish, so that the user inconveniently needs to wear nail polish again.

Further, since a thinner component is contained in nail polish, there is always a problem in that unless a stopper is completely covered, the nail polish is easily volatilized due to strong volatility that is a characteristic of nail polish. Accordingly, a stopper cannot completely maintain sealing force by a coupling method in the related art, so that there is a problem in that a liquid within a container is volatilized, so that the liquid is hardened or spoiled, thereby losing a function of a product.

SUMMARY OF THE INVENTION

The present invention has been made in an effort to provide an improved cosmetic container capable of providing a user with work convenience.

The present invention has also been made in an effort to provide a cosmetic container, which is capable of stably storing a product or a liquid to extend a lifespan of the product.

Other objects of the present invention are derivable by those skilled in the art through an exemplary embodiment below.

An exemplary embodiment of the present invention provides a cosmetic container, including: a main body, of which an inner side is extended through and in which a liquid material is stored; a rod insertion container inserted into the main body, and provided with one or more liquid inflow holes through which the liquid material stored in the main body flows in; a forcibly inserting means inserted into the rod insertion container, and including a housing, a forcibly inserting means inserted into the housing, and a push stick coupled with the pressing member and protruding from a front end of the housing; a brush supporting means including a housing accommodating part for accommodating the housing, an extendable part extended from the housing accommodating part so that the push stick is inserted into the extendable part, and formed to be extendable according to reciprocation of the push stick, a connection part extended from the extendable part, and a brush support piece, of which a part is inserted into the connection part, and on which a brush is mounted; an elastic member accommodated in the rod insertion container, and laid on at least a part of an outer peripheral surface of the brush support piece to restore the brush support piece, which has moved in a first direction outside the main body, in a second direction opposite to the first direction; and a cap coupled with the main body.

A container stopper provided with a first fastening part on an outer peripheral surface of the container stopper may be formed at a rear end of the rod insertion container, and a second fastening part fastened with the first fastening part may be formed inside a rear end of the main body, and a recess may be formed at an external side of the first fastening part in a longitudinal direction of the rod insertion container, or a through-hole may be formed inside the first fastening part.

The cosmetic container may further include a container stopper coupled to a rear end of the main body.

The container stopper may be provided with a through-hole, and the housing accommodating part may be inserted into the through-hole by a forcibly fitting method in a state where the housing is accommodated in the housing accommodating part, and one or more protrusions for a close contact between the housing and the housing accommodating part may be formed on an outer peripheral surface of the housing.

A front end of the rod insertion container may be accommodated in a front end of the main body, the front end of the rod insertion container may include a space, in which the brush is accommodated, therein, and an external side of the front end of the rod insertion container may be in close contact with an inner side of the front end of the main body.

The front end of the rod insertion container may be provided with one or more first through-holes through which the liquid material present in the main body flows into the space.

A start part of the front end of the rod insertion container and an external side of a center part provided with the first through-hole may be formed to be spaced apart from an inner side of the front end of the main body, and an external side of a distal part of the front end of the rod insertion container may be formed to be in close contact with an inner side of the front end of the main body.

A recess extended from the first through-hole in the second direction may be formed on an outer peripheral surface of a center part of the front end of the rod insertion container, and the liquid material present in the main body may flow along the recess and flow into the first through-hole, and the recess may be extended in the second direction, in such a manner that the recess may be extended in the second direction through a bent part extended in the first direction.

The cosmetic container may further include a guiding member fixed to and inserted into a start part of the front end of the rod insertion container, and including a guide hole for guiding a movement of the brush support piece in the first and second directions, and a receiving hole extended in the second direction and having a larger inner diameter than an inner diameter of the guide hole.

The brush support piece may include a diameter increasing part protruding from one region of the brush support piece and a diameter decreasing part, of which an outer diameter is decreased, in a lower region of the diameter increasing part, the liquid material present in the receiving hole may move in the first direction by the diameter increasing part, and flow into the space of the rod insertion container along an outer peripheral surface of the diameter decreasing part, an outer diameter of the diameter increasing part may correspond to an inner diameter of the receiving hole, and the outer diameter of the diameter decreasing part may be smaller than an inner diameter of the guide hole, and the diameter increasing part and the diameter decreasing part may enter the guiding member according to a movement of the brush support piece in the first direction, and the diameter decreasing part may start to leave the guide hole after the diameter increasing part starts to enter the receiving hole.

The brush support piece may include a diameter increasing part protruding from one region of the brush support piece and one or more through-holes formed in a lower region of the diameter increasing part, the through-holes may include a first through-hole and a second through-hole, the diameter increasing part, the first through-hole, and the second through-hole may enter the guiding member according to the movement of the brush support piece in the first direction, and the second through-hole may start to leave the guide hole after the diameter increasing part starts to enter the receiving hole, and the liquid material present within the receiving hole may flow into the first through-hole when the diameter increasing part enters the guiding member, and begin to be discharged through the second through-hole to flow into the space of the rod insertion container.

A front end of the push stick may be in contact with a rear end of the brush support piece, a rear end of the push stick and one end of the pressing member may be coupled by a screwing method, and the rear end of the push stick and one end of the pressing member may be separated at an unlock position, and the rear end of the push stick and one end of the pressing member may be coupled at a lock position, and the push stick may move in the first direction by external force applied to the pressing member at the lock position to move the brush provided at the front end of the brush support piece to an external side of the main body.

A shape of a cross-section of a center part of the push stick and a shape of a cross-section of a hole provided at the front end of the housing, through which the center part of the push stick passes through, may be a polygonal or elliptical shape, and the center part of the push stick may include a protruding region protruding from one region, and the push stick may not be reversely deviated from the housing after an external surface of the protruding region is inserted into the hole provided at the front end of the housing by a forcibly fitting method.

The external surface of the protruding region and an internal surface of the hole may be tapered in a direction in which the protruding region is inserted into the hole.

A latching member slidably formed in a direction crossing the first direction may be coupled to the other end of the pressing member, and the latching member may move in the direction crossing the first direction at a position where the pressing member is completely moved in the first direction, and restrict the pressing member from moving in the second direction in a state where one end of the latching member is latched to a border of the container stopper.

The pressing member may further include: a protrusion protruding from the other end of the pressing member; and a ring-shaped recess formed between the protrusion and the other end of the pressing member.

Another exemplary embodiment of the present invention provides a cosmetic container, including: a body part including a main body, of which an inner side is extended through, and in which a liquid material is stored, and an extendable part extendably formed at a rear end of the main body; a rod insertion container inserted into the body part, and provided with one or more liquid inflow holes through which the liquid material stored in the body part flows in; a brush support piece inserted into the rod insertion container, and mounted with a brush at a front end thereof; a pressing member coupled with a rear end of the brush support piece and accommodated inside the extendable part; an elastic member accommodated in the rod insertion container, and laid along at least a part of an outer peripheral surface of the brush support piece; a cap coupled to the front end of the body part; and a sealing stopper coupled to a rear end of the rod insertion container, and including a through-hole, in which one end of the pressing member passes through the through-hole to be coupled with a rear end of the brush support piece, and when external force is applied to the extendable part, the pressing member moves the brush in a first direction outside the body part, and when the external force is removed, the elastic member moves the brush in a second direction opposite to the first direction.

According to the exemplary embodiments of the present invention, it is possible to prevent a cosmetic liquid from being hardened inside a container by securing a sealing structure of the cosmetic container.

Further, according to the exemplary embodiments of the present invention, it is possible to stably keep a cosmetic container, thereby extending a lifespan of a product.

Further, according to the exemplary embodiments of the present invention, it is possible to enable a user to more conveniently and easily wear nail polish compared to an existing method in using a cosmetic container.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
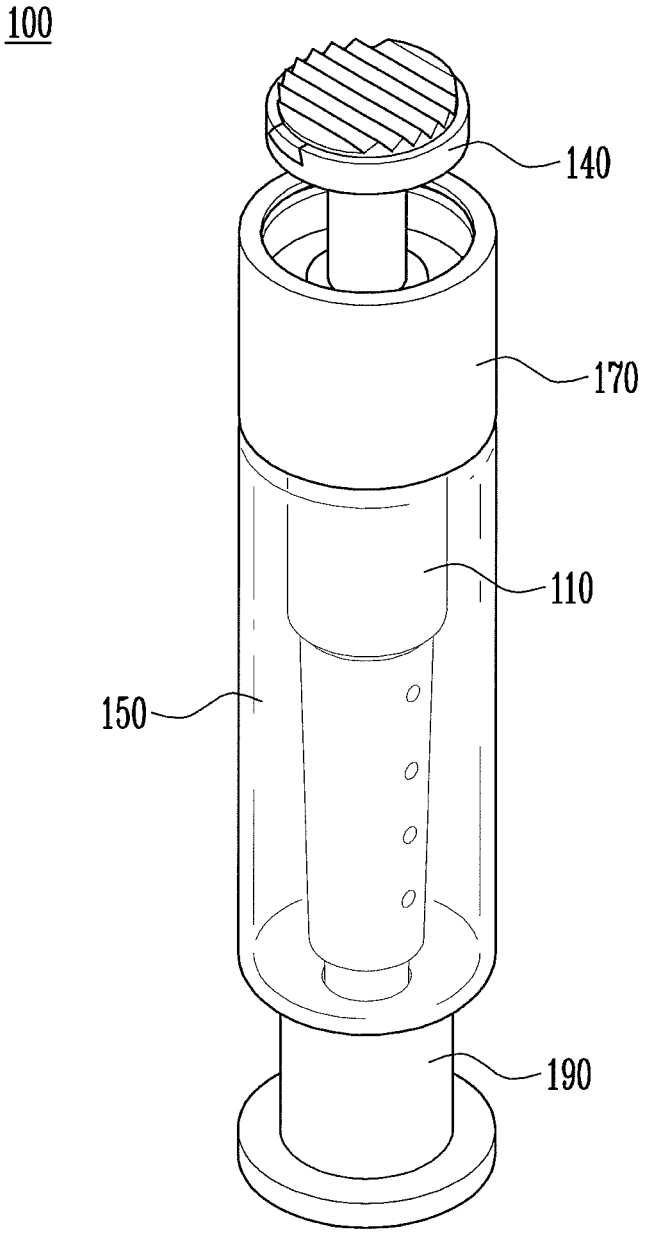
FIG. 1 is a perspective view of a cosmetic container according to an exemplary embodiment of the present invention.

The present invention may be variously modified and have various exemplary embodiments, so that specific embodiments will be illustrated in the drawings and described in the detailed description. However, it is not intended to limit the present invention to the specific embodiments, and it will be appreciated that the present invention includes all modifications, equivalences, or substitutions included in the spirit and the technical scope of the present invention. In the description of respective drawings, similar reference numerals designate similar elements.

A container of the present invention is applicable to all of the containers for containing a liquid material, such as nail polish, rip gloss, a correction fluid, having relatively high viscosity. Hereinafter, it is assumed for description that a material of a liquid injected into a container 100 is nail polish, and the container is a nail polish container, but the present invention is not limited thereto. Hereinafter, exemplary embodiments of the present invention will be described in detail with reference to accompanying drawings.

FIG. 1 is a perspective view of a cosmetic container according to an exemplary embodiment of the present invention.

The container 100 according to the exemplary embodiment of the present invention generally includes a body part 150 in which a material of a liquid, such as nail polish, is stored, a cap 190 provided at one side of the body part 150, a forcibly inserting means 140 provided at the other side of the body part 150, and a rod insertion container 110 for providing a passage of a brush moving by an operation of the forcibly inserting means 140.

The body part 150 may be formed of a transparent material or a semitransparent material so that nail polish inside the body part 150 may be viewed, or may adopt all of glass and synthetic resin materials.

In the cap 190, a lower surface is formed to be flat as illustrated in FIG. 1, so that the cosmetic container may be stood while the cap 190 faces a lower side when the container is kept.

Figure 2:
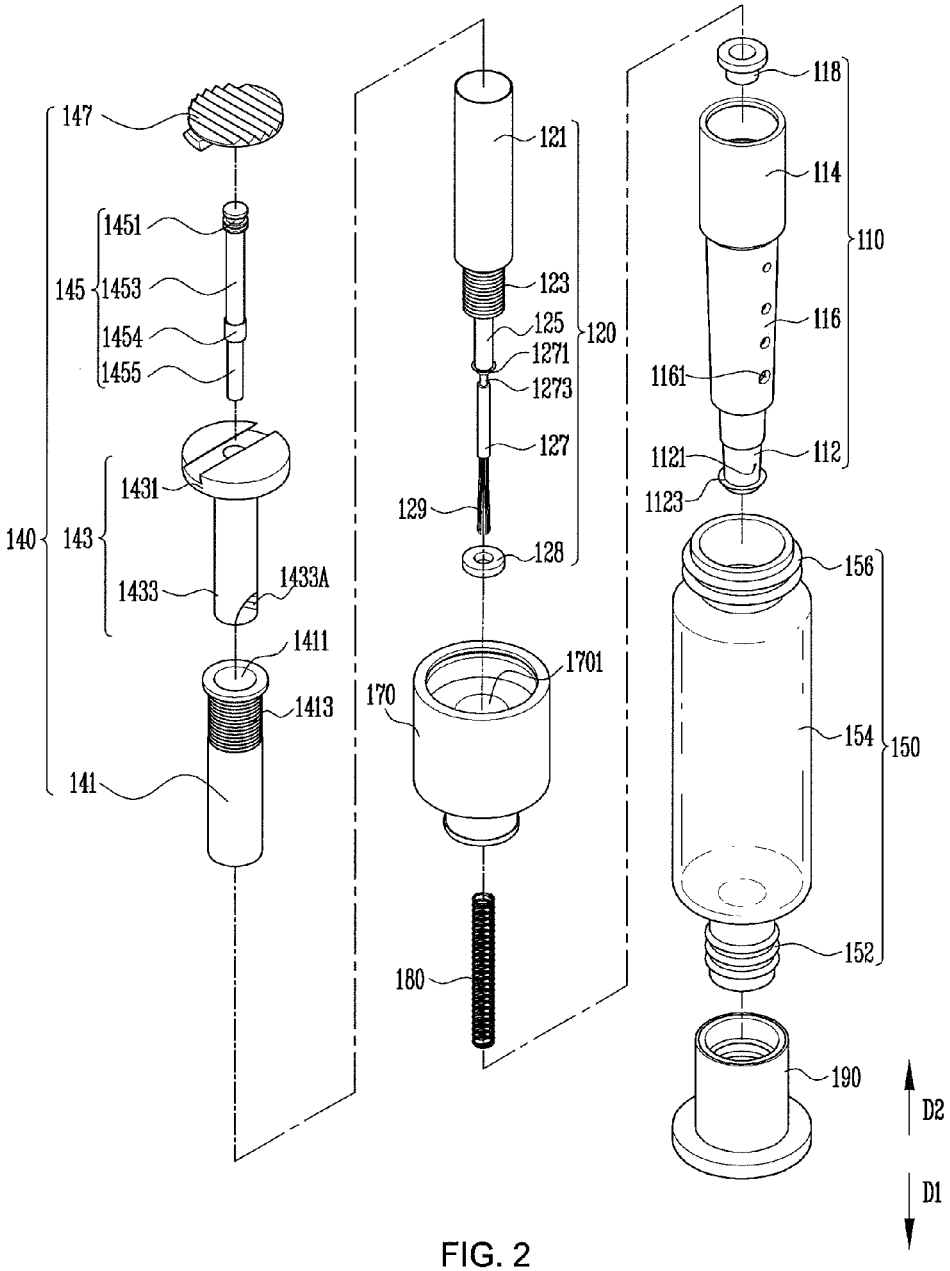
FIG. 2 is an exploded perspective view of the cosmetic container according to the exemplary embodiment of the present invention.

FIG. 2 is an exploded perspective view of the cosmetic container according to the exemplary embodiment of the present invention.

Referring to FIG. 2, the cosmetic container 100 according to the exemplary embodiment of the present invention includes the body part 150, of which an inner side is extended through, and in which a liquid material is stored, and the rod insertion container 110 provided with one or more liquid inflow holes 1161, into which nail polish stored in the body part 110 flows after being inserted into the body part 150.

Further, the cosmetic container 100 according to the exemplary embodiment of the present invention includes the forcibly inserting means 140 inserted into the rod insertion container 110. The forcibly inserting means 140 includes a housing 141, a pressing member 143 coupled to the housing 141, and a push stick 145 inserted into the pressing member 143 and protruding from a front end of the housing 141.

Further, the cosmetic container 100 according to the exemplary embodiment of the present invention includes a brush supporting means 120 including a brush 129. The brush supporting means 120 includes a housing accommodating part 121 for accommodating the housing 141 of the forcibly inserting means 140, an extendable part 123 extended from the housing accommodating part 121 so that the push stick is inserted, and extendably formed according to reciprocation of the push stick 145, a connection part 125 extended from the extendable part 123, and a brush support piece 127 of which a part is inserted into the connection part 125 and a front end is mounted with the brush.

Further, the cosmetic container 100 according to the exemplary embodiment of the present invention includes an elastic member 180 for allowing the brush support piece 127 to be elastically restorable or movable. The elastic member 180 is inserted into the rod insertion container 110 and is positioned on an outer peripheral surface of the brush support piece 127 to elastically restore the brush support piece 127, which has moved in a first direction D1 outside the body part 150, in a second direction D2 opposite to the first direction D1.

Further, the cosmetic container 100 according to the exemplary embodiment of the present invention may further include the cap 190 coupled to a front end 152 of the body part 150, and a container stopper 170 coupled to a rear end 156 of the body part 150. The container stopper 170 is provided with a through-hole 1701 inside thereof to be coupled to the rear end 156 of the body part 150. Further, a mail screw 1561 is formed at the rear end 156 of the body part 150 to be engaged with a female screw 1703 formed around the through-hole 1701 of the container stopper 170.

Further, the brush 129 is accommodated and positioned in a space inside a front end 112 of the rod insertion container 110, and a rear end 114 of the rod insertion container 110 may accommodate and be coupled with an external part of the through-hole 1701 protruding from the container stopper 170.

Further, the housing accommodating part 121 of the brush supporting means 120 is inserted into and coupled with the through-hole 1701 of the container stopper 170 in a state of being in external contact with and accommodating the housing 141 of the forcibly inserting means 140. In this case, a forcibly fitting method may be applied to the coupling method.

Further, one or more protrusions 1413 may be further formed no an outer peripheral surface of the housing 141 so that the housing 141 is firmly in close contact with the housing accommodating part 121. Here, the protrusion 1413 may be formed in a spiral form.

In a coupling structure of the cosmetic container 100 according to the exemplary embodiment of the present invention, the housing accommodating part 121 of the brush supporting means 120 is fixed to the container stopper 170 by a forcibly fitting method while accommodating the housing 141 of the forcibly inserting means 140, the rear end 114 of the rod insertion container 110 is coupled to the container stopper 170, and the rear end 156 of the body part 150 is fixed to the container stopper 170 again, so that a general framework of the cosmetic container 100 may be formed.

Further, a main body 154 of the body part 150 is a part hold by a hand of a user, and may be formed to have a larger diameter than those of the front end 152 and the rear end 156 of the body part 150. Further, the rear end 156 of the body part 150 coupled to the container stopper 170 has a larger diameter than that of the front end 152, thereby securing structural strength.

Figure 3:
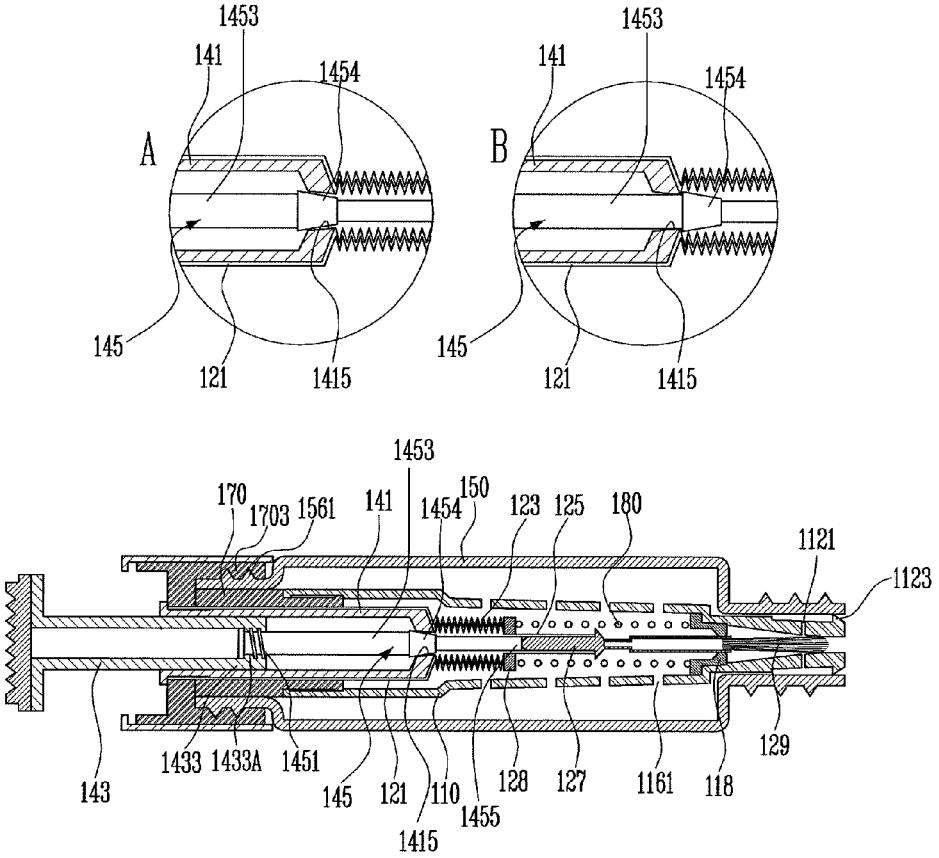
FIG. 3 is a cross-sectional view of the cosmetic container according to the exemplary embodiment of the present invention.
Figure 4:
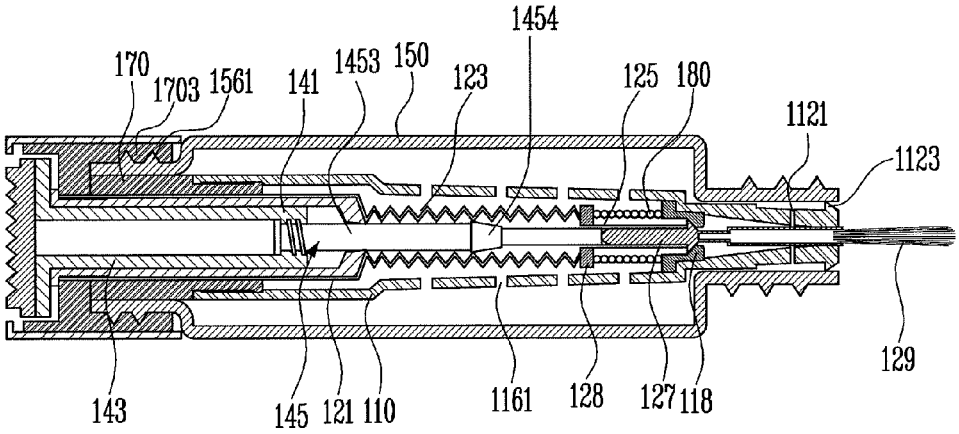
FIG. 4 is a cross-sectional view of the cosmetic container according to the exemplary embodiment of the present invention.

FIGS. 3 and 4 are cross-sectional views of the cosmetic container according to the exemplary embodiment of the present invention. In this case, FIG. 3 is a cross-sectional view of the case where the brush is accommodated inside the container, and FIG. 4 is a cross-sectional view of the case where the brush protrudes to the outside of the container. Hereinafter, an operation of the cosmetic container 100 according to the exemplary embodiment of the present invention will be described in more detail.

The forcibly inserting means 140 is a device for transmitting external force of the user to the brush supporting means 120, and includes the housing 141, the pressing member 143, and the push stick 145.

The push stick 145 moves according to external force applied in the first direction D1 in the state of being accommodated in the brush supporting means 120 and pushes and moves the brush support piece 127 of the brush supporting means 120 in the first direction D1.

The forcibly inserting means 143 moves in the first direction D1 and the second direction D2 in the state where at least a part of the pressing member 143 is accommodated in the housing 141, and one end 1433 of the pressing member 143 is formed to be coupled with the push stick 145, and external force of the user is applied to the other end 1431 of the pressing member 143.

More particularly, the push stick 145 may be divided into a rear end 1451 formed to be coupled with one end 1433 of the pressing member 143, a front end 1455 which is in contact with the brush support piece 127 of the brush supporting means 120, and a center part 1453 moving through the housing 141.

The rear end 1451 of the push stick 145 may be coupled with a spiral 1433A formed on an inner part of one end 1433 of the pressing member 143 by a screwing method. That is, the rear end 1451 of the push stick 145 and one end 1433 of the pressing member 143 may be separated from each other at an unlock position, and the rear end 1451 of the push stick 145 and one end 1433 of the pressing member 143 may be coupled at a lock position. Through the aforementioned structure, the pressing member 143 may push and move the push stick 145 in the first direction D1 only at the lock position between the unlock position and the lock position.

That is, the push stick 145 and the pressing member 143 according to the exemplary embodiment of the present invention may be integrally coupled with each other as necessary to transmit external force applied in the first direction D1 up to the brush support piece 127 supporting the brush 129, and be separated from each other as necessary so as not to transmit external force applied in the first direction D1 to the brush support piece 127. Here, the former case may be considered as a situation where a user uses the cosmetic container, and the latter case may be considered as a situation where the cosmetic container is kept after use.

For example, when the user uses the cosmetic container, the user takes the brush 129, which has been immersed into the nail polish, out of the body part 150 to wear the nail polish by turning the pressing member 143 in a counterclockwise direction to couple the pressing member 143 to the push stick 145, and then pressing the pressing member 143 in the first direction D1, and further, when the nail polish is kept for a long time, the user turns the pressing member 143 in a clockwise direction to separate the pressing member 143 from the push stick 145, so that even though the pressing member 143 is pressed by undesired external force, the brush 129 may be prevented from being drawn out from the body part 150. That is, even if the pressing member 143 is pushed as illustrated in FIG. 4, the brush 129 is not drawn to the outside.

In the meantime, in order for the user to couple one end 142 of the pressing member 143 and the rear end 1451 of the push stick 145 by turning the pressing member 143 in the counterclockwise direction, it is necessary to fix the push stick in order to prevent the push stick 145 from being rotated together when rotating the pressing member 143.

To this end, the center part 1453 of the push stick 145 may have a different cross-sectional shape from that of the front end 1455 or the rear end 1451.

For example, cross-sectional shapes of the front end 1455 and the rear end 1451 of the push stick 145 may be circular shapes, and a cross-sectional shape of the center part 1453 may be a polygonal shape or an elliptical shape. Further, a cross-sectional shape of a hole 1415 formed at a front end of the housing 141, through which the center part of the push stick 145 passes, may also have a polygonal or elliptical shape.

As described above, the center part 1453 of the push stick 145 is an element which moves while passing through one side of the housing 141, and the housing 141 is fixed to the container stopper 170 together with the housing accommodating part 121 of the brush supporting means 120, so that, by configuring the cross-sectional shape of the center part 1453 of the push stick 145 in a polygonal or elliptical shape, the push 145 may not be rotated together with the pressing member 143 even if the pressing member 143 connected with the push stick 145 is rotated, and the rear end 1451 of the push stick 145 may be coupled to the spiral 1433A formed at one end 1433 of the pressing member 143 by a screwing method.

In the above, it has been described that the pressing member 143 is coupled with the push stick 145 when being rotated in the counterclockwise direction, but the spiral 1433A may be formed so that the pressing member 143 is coupled with the push stick 145 when being rotated in the clockwise direction.

According to the exemplary embodiment of the present invention, the center part 1453 of the push part 145 includes a protruding region 1454 protruding from one region thereof, and an external surface of the protruding region 1454 and an internal surface of the hole 1415 may have a shape tapered in a direction in which the protruding region 1454 is inserted into the hole 1415.

A and B of FIG. 3 are enlarged view of the push stick 145 and the housing accommodating part 121. Referring to A of FIG. 3, the protruding region 1454 having the tapered shape is inserted into the hole 1415 in a forcibly fitting form. A rear end of the once inserted protruding region 1454 is latched to a front end of the hole 1415 as illustrated in B of FIG. 3, so that the push stick 145 is prevented from being inversely departed from the housing accommodating part 121 in the second direction D2. In the exemplary embodiment of the present invention, the tapered shape has been suggested as an example, but various methods for preventing the inverse departure may be used as a matter of course.

According to the exemplary embodiment of the present invention, the extendable part 123 of the brush supporting means 120 is extendably formed in the first direction D1 and the second direction D2 according to a movement of the push stick 145 in the state where the housing accommodating part 121 is fixed to the container stopper 170. To this end, the extendable part 123 may be formed of a flexible material. In FIG. 2, it is assumed that the extendable part 123 has a wrinkled shape, but various structures may be applied to the extendable part for an extension operation.

The push stick 145 gets into and out of the rod insertion container 110 in a state of being accommodated in the housing accommodating part 121 and the extendable part 123, so that the push stick 145 is not directly exposed to the nail polish. When the push stick 145 gets into and out of the rod insertion container 110 without the configurations of the housing accommodating part 121 and the extendable part 123 in FIGS. 3 and 4, the push stick 145 is stained with the nail polish when the brush 129 protrudes to the outside of the body part 150. When the brush 129 is accommodated inside the body part 150 again, the push stick 145 moves into the housing 141. In this case, the nail polish stained on the center part 1453 of the push stick 145 may be exposed to the air and hardened. In this case, there may be a problem in that the center part 1453 of the push stick 145 does not smoothly move the hole 1451 formed at the front end of the housing 141.

That is, the extendable part 123 prevents the push stick 145 from being directly exposed to the nail polish while being extended and contracted according to a movement of the push stick 145 in the first direction D1 and the second direction D2, thereby enabling the push stick 145 to smoothly move.

According to the exemplary embodiment of the present invention, the cosmetic container 100 provides a sealing structure so as to protect nail polish which is easily hardened by a contact with external air.

That is, as illustrated in FIGS. 2 to 4, the housing accommodating part 121 may be fixed between the housing 141 and the container stopper 170 by a forcibly fitting method, and the brush supporting means 120 may be extended and contracted in the first and second directions in the state where the housing accommodating part 121 is fixed between the housing 141 and the container stopper 170. For sealing, an outer diameter of the housing 141 may correspond to an inner diameter of the housing accommodating part 121, and an inner diameter of the container stopper 170 may correspond to an outer diameter of the housing accommodating part 121.

In the meantime, according to the exemplary embodiment of the present invention, the elastic member 180 is accommodated in the rod insertion container 110 and is laid along an outer peripheral surface of at least a part of the brush support piece 127 to restore the brush support piece 127, which has moved in the first direction D1, in the second direction D2. Accordingly, when external force applied to the other end 1431 of the pressing member 143 in the first direction D1 is removed, the brush support piece 127 may move in the second direction D2, and the brush 129, which has get out of the rod insertion container 110, may move in the second direction D2 together with the brush support piece 127 and enter a space within the front end 112 of the rod insertion container 110 again.

In this case, the nail polish is present in the space within the front end 112 of the rod insertion container 110, which will be described below, so that the brush 129 is immersed into the nail polish, and the user may wear the nail polish stained on the brush on a desired position by pressing the pressing member 143 again.

According to the exemplary embodiment of the present invention, in order to fix the elastic member 180, a ring-shaped member 128 may be inserted and fixed between the brush support piece 127 of the brush supporting means 120 and the extendable part 123, and a guiding member 118, which will be described below, may be utilized for fixing the elastic member at an opposite side of the ring-shaped member 128.

That is, one end of the elastic member 180 may be fixed to the guiding member 118, and the other end of the elastic member 180 may be fixed to the ring-shaped member 128.

According to the exemplary embodiment of the present invention, the liquid inflow holes 1161 formed in the rod insertion container 110 form a path, through which the nail polish present inside the main body 154 of the body part 150 flows into the center region 116 of the rod insertion container 110, or the nail polish present inside the center region 116 is discharged into the main body 154.

As described above, the brush supporting means 120 and the elastic member 180 are accommodated in the rod insertion container 110, and the extendable part 123 is elongated in the first direction D1 within the rod insertion container 110 by the pressing member 143 and the push stick 145 or contracted in the second direction D2 within the rod insertion container 110 by the elastic member 180.

In this case, a pressure within the rod insertion container 110 may be increased according to an extension operation of the extendable part 123, and according to the exemplary embodiment of the present invention, the nail polish communicate with inside and outside the rod insertion container 110 through the plurality of liquid inflow holes 1161 formed in the rod insertion container 110, so that a general pressure may be constantly maintained within the container 100.

Further, whenever the user extends and contracts the extendable part 123 by pressing the pressing member 143, the nail polish within the container 100 is evenly mixed, thereby preventing the nail polish from being hardened.

Referring back to FIG. 2, for a more convenient operation of the user during the use of the cosmetic container, a latching member 147 formed to slidably move in a direction crossing the first direction D1 may be coupled to the other end 1431 of the pressing member 143 according to the exemplary embodiment of the present invention.

The latching member 147 may slide in a direction crossing the first direction D1 at a position, at which the sliding movement of the pressing member 143 in the first direction D1 is completed, that is, a position where the user uses the nail polish, and thus one end of the latching member 147 is latched to a border of the container stopper 170, so that the pressing member 143 may be restricted from moving in the second direction D2.

Accordingly, the user is not required to continuously press the pressing member 143 in order to use the nail polish, and may conveniently use the nail polish after fixing the pressing member 143 by using the latching member 147.

By contrast, in order to stain the brush 129 with the nail polish again, the user may return the latching member 147 into an original position, and in this case, the brush support piece 127 may be restored in the second direction D2 by the aforementioned elastic member 180, so that the brush 129 may enter the space within the front end 112 of the rod insertion container 110 again and be immersed into the nail polish.

Figure 5:
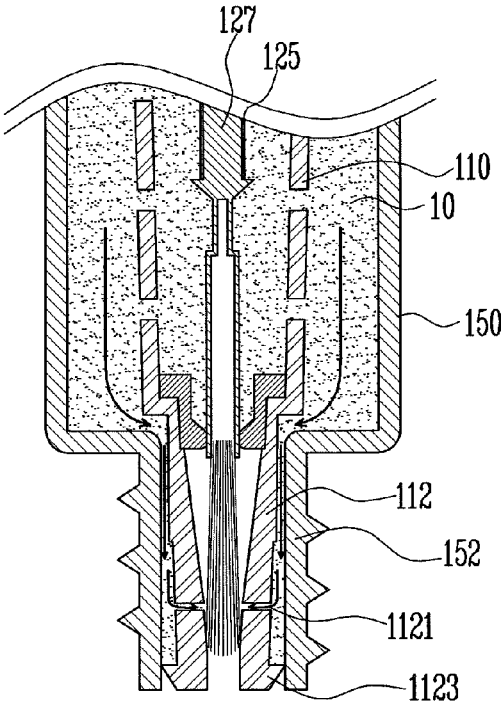
FIG. 5 is a diagram schematically illustrating a flow of nail polish within the cosmetic container when a brush faces downwardly according to the exemplary embodiment of the present invention.

FIG. 5 is a diagram schematically illustrating a flow (arrow) of nail polish 10 within the cosmetic container 100 when the brush 129 faces downwardly according to the exemplary embodiment of the present invention.

Referring to FIG. 5, one or more first through-holes 1121 for making the nail polish present in the body part 150 flow into the space within the front end 112 of the rod insertion container 110 may be formed at the front end 112 of the rod insertion container 110.

For example, two first through-holes 1121 may be formed at facing positions. Further, a starting part of the front end 112 of the rod insertion container 110 and an external side around a center part of the rod insertion container 110 in which the first through-holes 1121 are formed are formed to be spaced apart from an inner side of the front end 152 of the body part 150, and an external side of an end part 1123 of the front end 112 of the rod insertion container 110 may be formed to be in close contact with the inner side of the front end 152 of the body part 150.

That is, when the user holds the container 110 so that the brush 129 faces downwardly in order to use the nail polish, the nail polish 10 present inside the main body 154 flow into a spaced gap between the outer peripheral surface of the front end 112 of the rod insertion container 110 and the front end 152 of the body part 150 and flow into the first through-holes 1121. Further, an external side of the end part 1123 of the front end 112 of the rod insertion container 110 is formed to be in close contact with the inner side of the front end 152 of the body part 150, thereby preventing the nail polish from leaking from the container.

In brief, in order to make the nail polish present in the main body 154 flow into the space inside the front end 112 of the rod insertion container 110, in which the brush 129 is positioned, clearance may be formed between the front end 112 of the rod insertion container 110 and the front end 152 of the body part 150 by varying a diameter of the front end 112 in a longitudinal direction.

Figure 6:
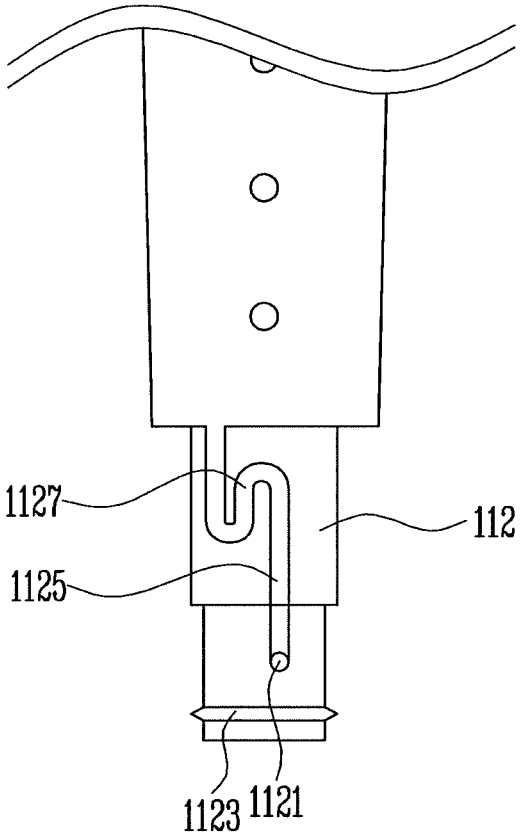
FIG. 6 is an enlarged view of a front end of a rod insertion container according to another exemplary embodiment of the present invention.

FIG. 6 is an enlarged view of the front end 112 of the rod insertion container 110 according to another exemplary embodiment of the present invention.

Referring to FIG. 6, a recess 1125 extended in the second direction D2 is formed on the outer peripheral surface of the front end 112 of the rod insertion container 110, so that clearance may also be formed between the front end 112 of the rod insertion container 110 and the front end 152 of the body part 150.

Even in this case, the nail polish present inside the main body 154 of the body part 150 may flow along the recess 1125 by gravity and flow into the first through-holes 1121.

In this case, the recess 1125 according to the exemplary embodiment of the present invention is extended in the second direction D2, in such a manner that the recess 1125 may be extended in the second direction D2 through a bent part 1127 extended in the first direction D1.

That is, the recess 1125 is extended from the first through-hole 1121 in the second direction D2, and bent and extended in the first direction D1, and bent again and extended in the second direction D2.

This makes the nail polish be left in the bent part 1127 when the user turns the cosmetic container upside down so that the brush 129 faces upwardly during the use of the cosmetic container, thereby preventing the nail polish inside the main body 154 from being in direct contact with external air. Further, when the user suddenly turns the cosmetic container upside down so that the brush 129 faces downwardly, the nail polish left in the bent part 1127 serves a bumper action to nail polish, which newly flows into the first through-hole 1121 from the inner side of the main body 154, thereby preventing the nail polish from suddenly pouring down.

FIGS. 7A to 7D are diagrams additionally a process, in which the nail polish flows into the front end 112 of the rod insertion container 110 according to an exemplary embodiment of the present invention.

Figure 7A:
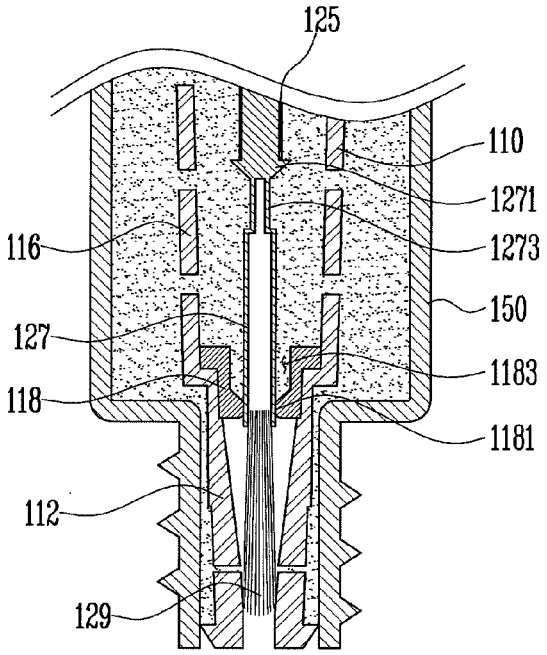
FIG. 7A is a diagram additionally illustrating a process, in which nail polish flows into a front end of a rod insertion container according to an exemplary embodiment of the present invention.

First, referring to FIG. 7A, the brush support piece 127 of the brush supporting means 120 is movable in the first direction and the second direction in the state of being inserted into the guiding member 118.

In this case, the guiding member 118 may guide a sliding movement of the brush support piece 127 in the state of being fixed between the front end 112 and the center region 116 of the rod insertion container 110. The brush support piece 127 is movable by the operations of the push stick 145 and the pressing member 143, which has been described above.

A guide hole 1181 is formed in the guiding member 118 so that a sliding movement of the brush support piece 127 may be guided by the guiding member 118. Further, the guiding member 118 may be provided with a receiving hole 1183, which is extended from the guide hole 1181 in the second direction D2 and has a larger inner diameter than an inner diameter of the guide hole 1181 to receive the nail polish 10.

Further, the brush support piece 127 may be provided with a diameter increasing part 1271 protruding from one region of the brush support piece 127. More particularly, as illustrated in FIGS. 7B and 7C, the diameter increasing part 1271 moves together according to a movement of the brush support piece 127 in the first direction D1 to make the nail polish 10 present in the receiving hole 1183 of the guiding member 118 flow into the space within the front end 112 of the rod insertion container 110.

To this end, an outer diameter of the diameter increasing part 1271 may correspond to an inner diameter of the receiving hole 1183 formed in the guiding member 118. That is, the diameter increasing part 1271 pushes the nail polish present in the receiving hole 1183 in the first direction D1 and makes the nail polish flow into the front end 112 in the state of being in close contact with the receiving hole 1183.

Further, in order to make the nail polish 10 present inside the receiving hole 1183 flow from a point of entrance to the receiving hole 1183 of the diameter increasing part 1271 into the front end 112, a diameter decreasing part 1273, of which an outer diameter is decreased, is formed in a lower region of the diameter increasing part 1271 on the brush support piece 127. The diameter decreasing part 1273 may be formed by decreasing the outer diameter of the brush support piece 127 or cutting a recess in the brush support piece 127. The outer diameter of the diameter decreasing part 1273 is formed to be smaller than the inner diameter of the guide hole 1181 formed in the guiding member 118.

Figure 7B:
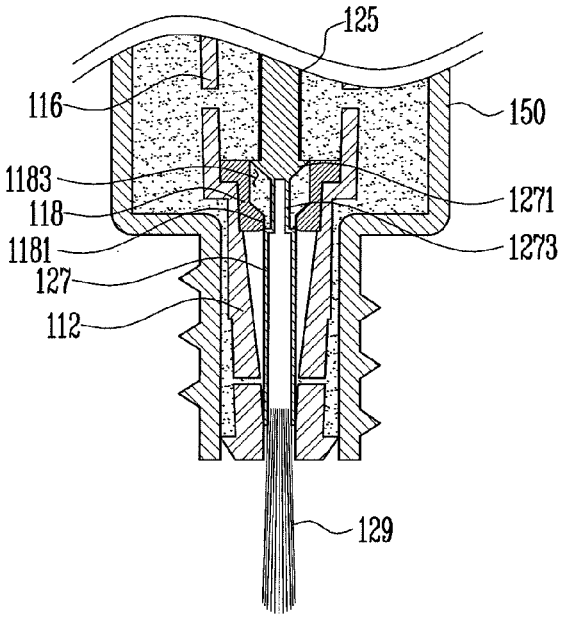
FIG. 7B is a diagram additionally illustrating a process, in which nail polish flows into a front end of a rod insertion container according to an exemplary embodiment of the present invention.
Figure 7C:
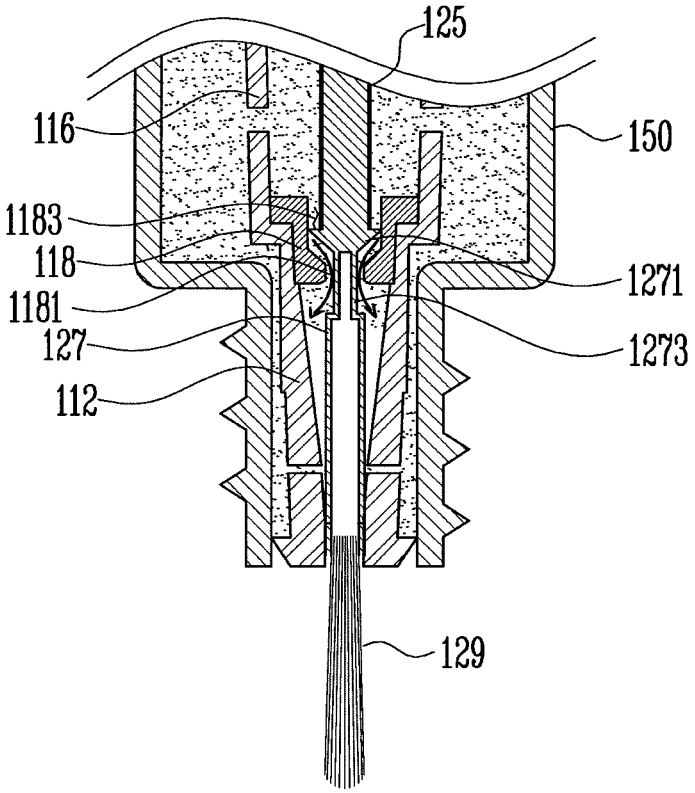
FIG. 7C is a diagram additionally illustrating a process, in which nail polish flows into a front end of a rod insertion container according to an exemplary embodiment of the present invention.
Figure 7D:
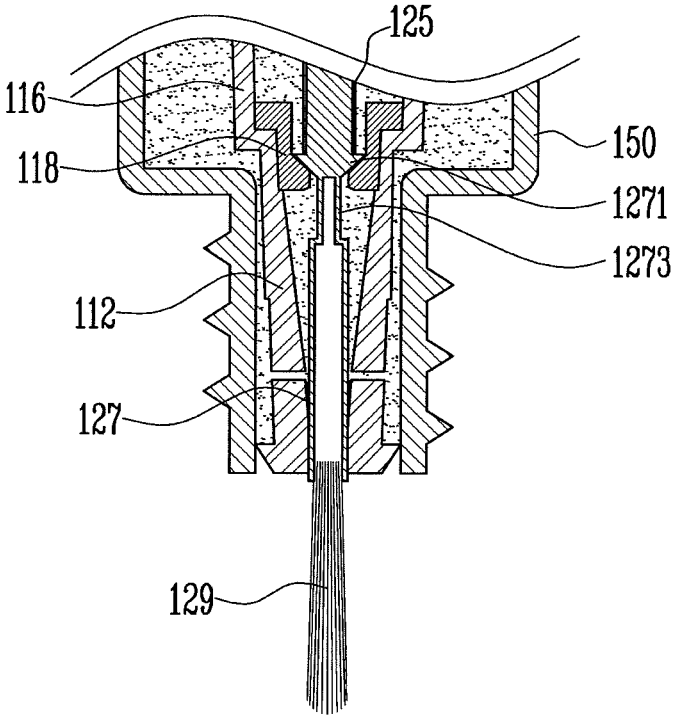
FIG. 7D is a diagram additionally illustrating a process, in which nail polish flows into a front end of a rod insertion container according to an exemplary embodiment of the present invention.

A predetermined section, in which the diameter decreasing part 1273 is formed on the brush support piece 127 may be formed at a section in which the diameter decreasing part 1123 gets out of the guide hole 1181 when the diameter increasing part 1271 enters the receiving hole 1183 as illustrated in FIG. 7B.

That is, when the diameter increasing part 1271 enters the receiving hole 1183, the diameter decreasing part 1273 also enters inside the front end 112 of the rod insertion container 110. In this case, the nail polish 10 may move in the first direction D1 by the diameter increasing part 1271 present inside the receiving hole 1183 and flow into the space within the front end 112 of the rod insertion container 110 along the outer peripheral surface of the diameter decreasing part 1273.

By the structure, when the user presses the pressing member 143 for wearing the nail polish, the nail polish present in the center region 116 of the rod insertion container 110 may be stably charged into the space within the front end 112, and the brush 129, from which the nail polish is removed after the manicure, may move back to the space within the front end 112 again to be immersed into the charged nail polish.

Further, when the presses the pressing member 143 for wearing the nail polish and the amount of nail polish stained on the brush 129 is small, the user may press the pressing member 143 one more time, and in this case, the diameter increasing part 1271 and the diameter decreasing part 1273 may make the nail polish present in the receiving hole 1183 additionally flow into the front end 112, so that the brush 129 may be sufficiently stained with the nail polish.

In the meantime, the cap 190 is coupled with the front end 152 of the body part 150, so that the front end 112 of the rod insertion container 110, which is a position where the brush 129 is immersed into the nail polish, is prevent from external air.

Figure 8A:
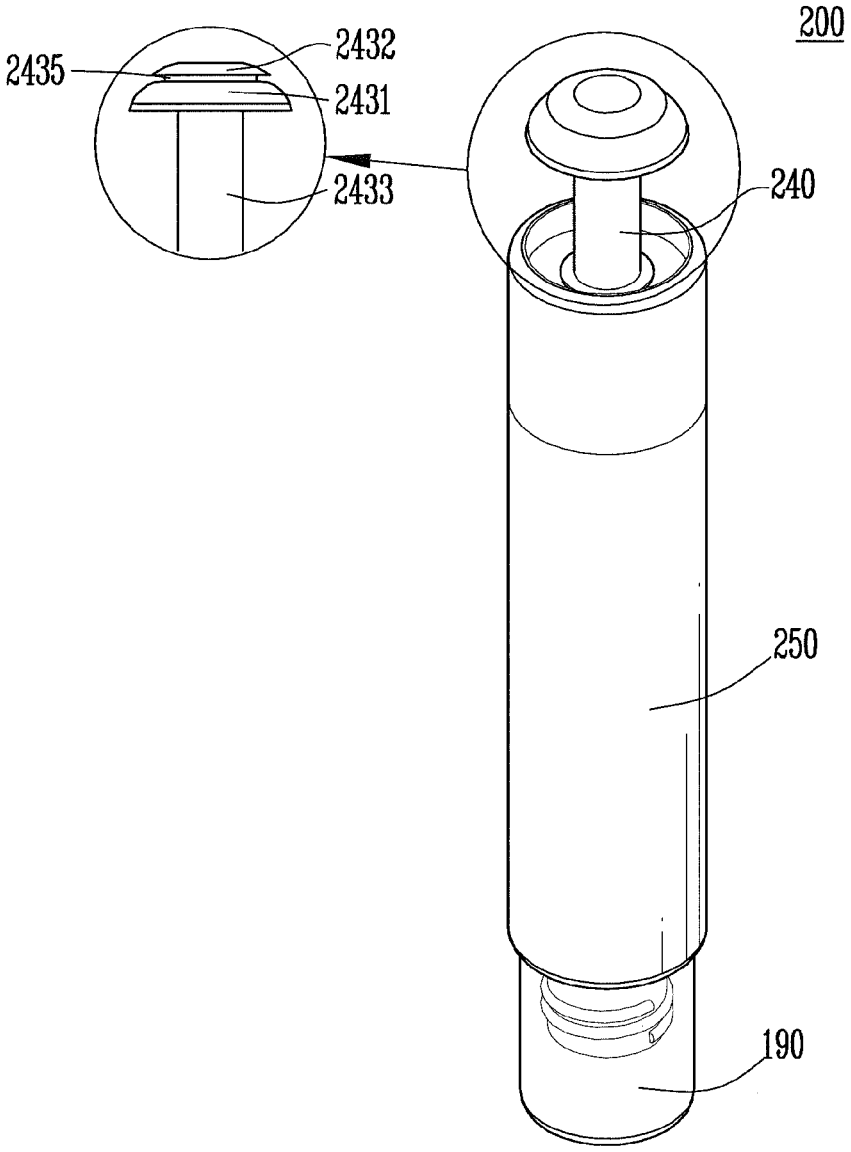
FIG. 8A is a perspective view of a cosmetic container according to another exemplary embodiment of the present invention.
Figure 8B:
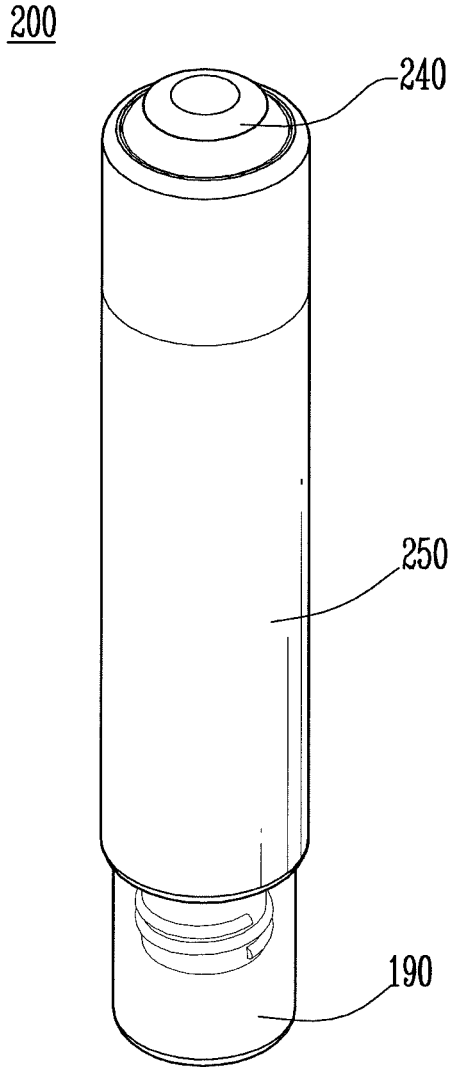
FIG. 8B is a perspective view of a cosmetic container according to another exemplary embodiment of the present invention.
Figure 9:
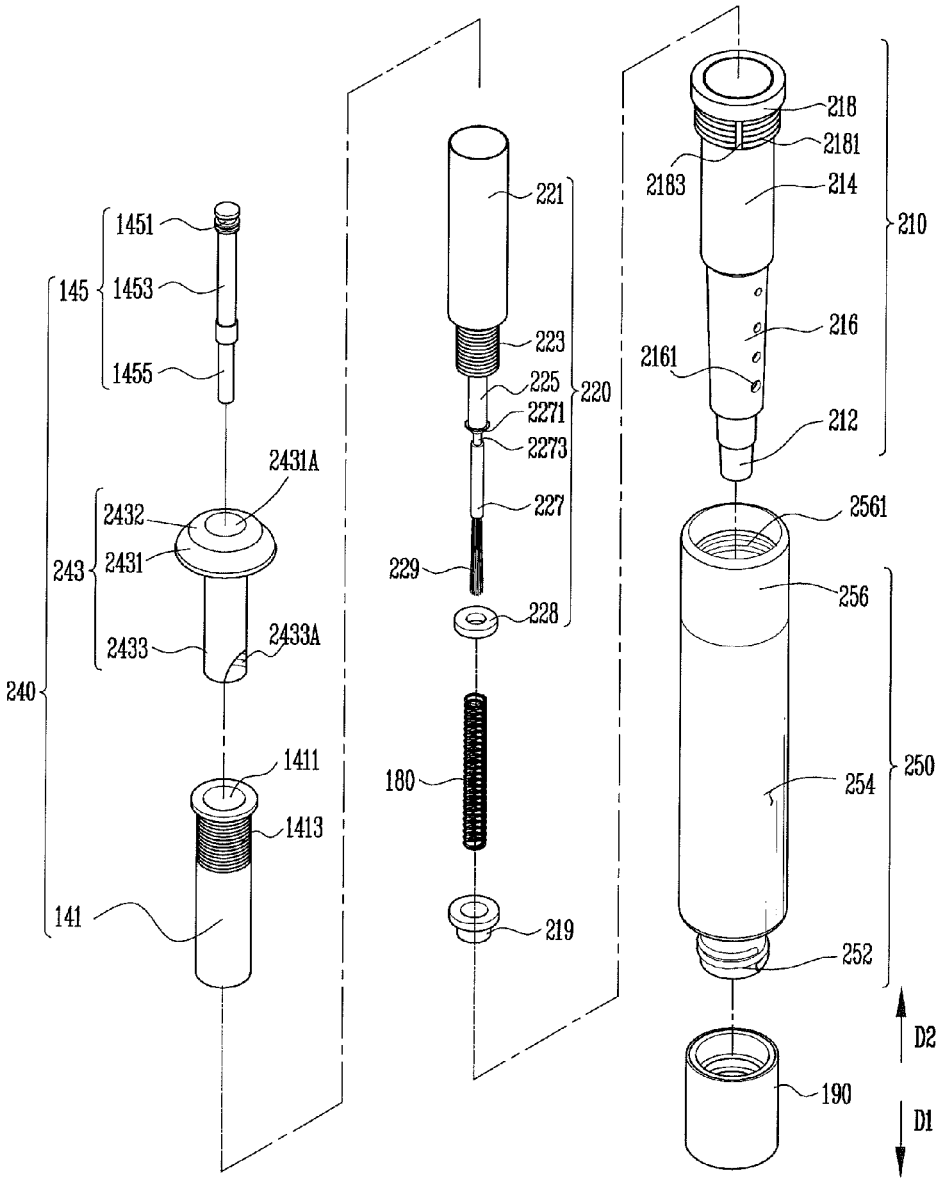
FIG. 9 is an exploded perspective view of the cosmetic container of FIGS. 8A and 8B.
Figure 10:
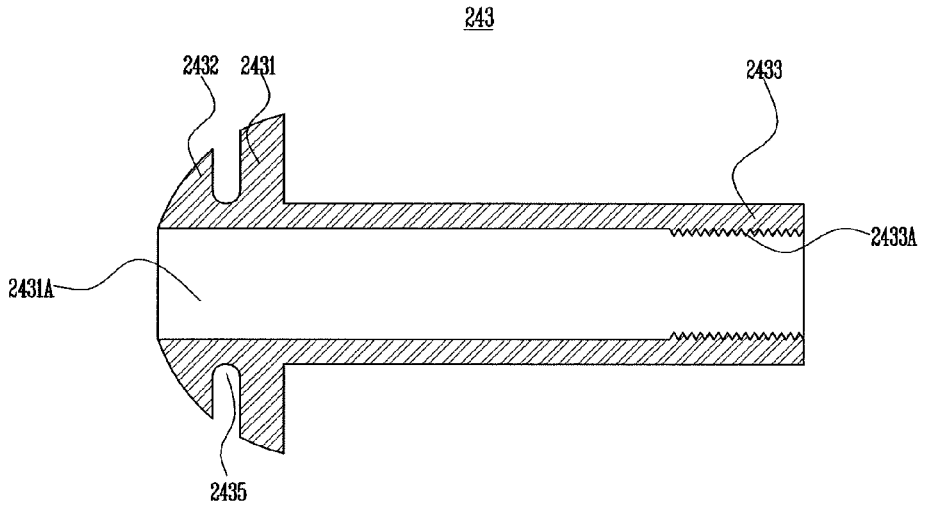
FIG. 10 is a cross-sectional view of a pressing member of FIGS. 8A and 8B.

FIGS. 8A and 8B are perspective views illustrating a cosmetic container according to another exemplary embodiment of the present invention, and FIG. 9 is an exploded perspective view of the cosmetic container of FIGS. 8A and 8B. FIG. 10 is a cross-sectional view of a pressing member of FIGS. 8A and 8B.

In the configuration illustrated in FIGS. 8 to 10, the same elements as those of the cosmetic container described with reference to FIGS. 1 to 7 are denoted by the same reference numerals, and descriptions thereof will be omitted.

Referring to FIGS. 8A and 8B, FIG. 8A is a diagram illustrating a cosmetic container in a case where a forcibly inserting means 240 protrudes, and FIG. 8B is a diagram illustrating a case where the forcibly inserting means 240 is accommodated in a cosmetic body part 250. For convenience of the description, a cross-sectional view of a partial region of the forcibly inserting means 240 is illustrated together.

Referring to FIGS. 8A and 8B, the forcibly inserting means 243 may further include a protrusion 2432 protruding from the other end 2432 of the forcibly inserting means 243. Further, a ring-shaped recess 2435 for easily drawing out the forcibly inserting means by using a nail and the like may be formed between the protrusion 2432 and the other end 2431 of the forcibly inserting means 243. As can be seen in FIG. 8*b*, even when the forcibly inserting means 240 is accommodated in the body part 250, the protrusion 2432 protrudes to the outside of the body part 250. Accordingly, the user may easily draw out the forcibly inserting means 243 to the outside of the body part 250 by using the protrusion 2432 and the ring-shaped recess formed between the protrusion 2432 and the other end 2431 of the forcibly inserting means 243 when using the cosmetic container.

Referring to FIG. 9, a cosmetic container 200 according to another exemplary embodiment of the present invention includes the body part 250 having a through inner side, a rod insertion container 210 inserted into the body part 250 from a rear side of the body part 250, the forcibly inserting means 240 inserted into the rod insertion container 210, a brush supporting means 220 positioned inside the rod insertion container 210, an elastic member 180 for elastically moving the brush supporting means 220, and a cap 190 for covering one side of the body part 250.

The rod insertion container 210 is inserted into the body part 250 from the rear side of the body part 250, and is provided with one or more liquid inflow holes 2161, through which a liquid material to be contained in the body part 250 flows in, and a container stopper 218 at a rear end 214.

Further, the forcibly inserting means 240 is inserted into the rod insertion container 210, and includes a housing 141, a pressing member 243 inserted into the housing 141, and a push stick 145 inserted into a through-hole 2431A of the pressing member 243 to protrude from a front end of the housing 141.

More particularly, the push stick 145 may be divided into a rear end 1451 formed to be coupled with one end 2433 of the pressing member 243, a front end 1455 which is in contact with the brush support piece 227 of the brush supporting means 220, and a center part 1453 moving through the housing 141.

The rear end 1451 of the push stick 145 may be coupled with a spiral 2433A formed on an inner part of one end 2433 of the pressing member 241 illustrated in the cross-sectional view of the pressing member 243 of FIG. 10 by a screwing method. That is, the rear end 1451 of the push stick 145 and one end 2433 of the pressing member 243 may be separated from each other at an unlock position, and the rear end 1451 of the push stick 145 and one end 2433 of the pressing member 243 may be coupled at a lock position. Through the aforementioned structure, the pressing member 243 may push and move the push stick 145 in the first direction D1 only at the lock position between the unlock position and the lock position. Further, the brush supporting means 220 includes a housing accommodating part 221 for accommodating the housing 141, an extendable part 223 extended from the housing accommodating part 221 so that the push stick 145 is inserted into the extendable part 223 and formed extendably according to reciprocation of the push stick 145, a connection part 225 extended from the extendable part 223, and a brush support piece 227 of which a part is inserted into the connection part 225. A brush 229 is provided at a front end of the brush support piece 227.

Further, the elastic member 180 is accommodated in the rod insertion container 210 and is positioned along an outer peripheral surface of at least a part of the brush support piece 227 to restore the brush support piece 227, which has moved in a first direction D1 outside the body part 250, in a second direction D2 opposite to the first direction D1.

Further, the cap 190 may be coupled to a front end 252 of the body part 250.

Hereinafter, the cosmetic container will be described in more detail together with an operation of each element.

First, the rod insertion container 210 may be inserted into the body part 250 from a rear side, and a first fastening part 2181 formed on an outer peripheral surface of the container stopper 218 may be fastened with a second fastening part 2561 formed inside the rear end 256 of the body part 250.

The brush 229 is accommodated and positioned in one region inside the front end 212 of the rod insertion container 210. Further, the housing accommodating part 221 of the brush supporting means 220 is inserted into the through-hole 2183 formed in the container stopper 218 by a forcibly fitting method in the state of accommodating the housing 141 of the forcibly inserting means 240. In this case, a protrusion 1413 shaped like a spiral for a close contact with the housing accommodating part 221 may be formed on an outer peripheral surface of the housing 141.

In general, the cosmetic container 200 according to another exemplary embodiment of the present invention has a structure in which other elements are coupled based on the rod insertion container 210, and as described above, the housing accommodating part 221 of the brush supporting means 220 is fixed to the through-hole 2183 of the container stopper 218 formed in the rear end 214 of the rod insertion container 210 while accommodating the housing 141 by a forcibly fitting method, and the rear end 256 of the body part 250 is fixed to the container stopper 218 to form a general framework of the cosmetic container 100.

In this case, the through-hole 2183 formed in the container stopper 281 is sealed by the forcible fitting of the housing accommodating part 221, so that when the first fastening part 2181 formed on the outer peripheral surface of the container stopper 281 is fastened with the second fastening part 2561 formed inside the rear end 256 of the body part 250, it may be difficult to couple the body part 250 and the rod insertion container 210 due to an increase in a pressure inside the body part 250.

Figure 11:
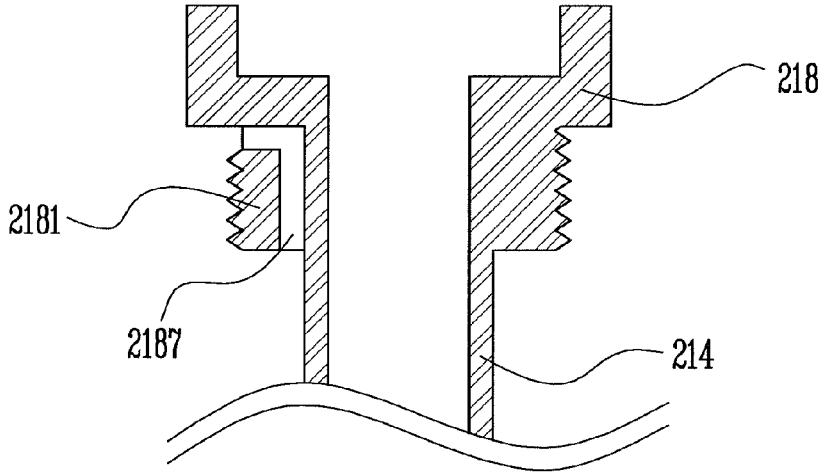
FIG. 11 is a cross-sectional view of a part of a front end of a rod insertion container according to another exemplary embodiment of the present invention.

Accordingly, according to another exemplary embodiment of the present invention, a recess 2185 serving as an air passage may be formed in the first fastening part 2182 in a longitudinal direction of the rod insertion container 210. Accordingly, when the rod insertion container 210 is inserted into and coupled with the container, into which nail polish is injected, inside air may be discharged through the recess 2185, so that the body part 250 may be easily coupled with the rod insertion container 210. When the body part 250 is formed of glass, and the like, an air passage may be typically secured between the fastening parts, such as a spiral, so that a necessity of forming a separate structure of the recess 2185 is not high. However, when the body part 250 is formed of plastic, and the like, the air passage shaped like a recess is necessary. A form of the air passage may be provided by various methods. For example, FIG. 11 is a cross-sectional view of the front end of the rod insertion container, and as illustrated in FIG. 11, a through-hole 2187 passing through inside the first fastening part 2181 in vertical and horizontal directions may be formed so that inside air may be discharged through the through-hole 2187.

Figure 12:
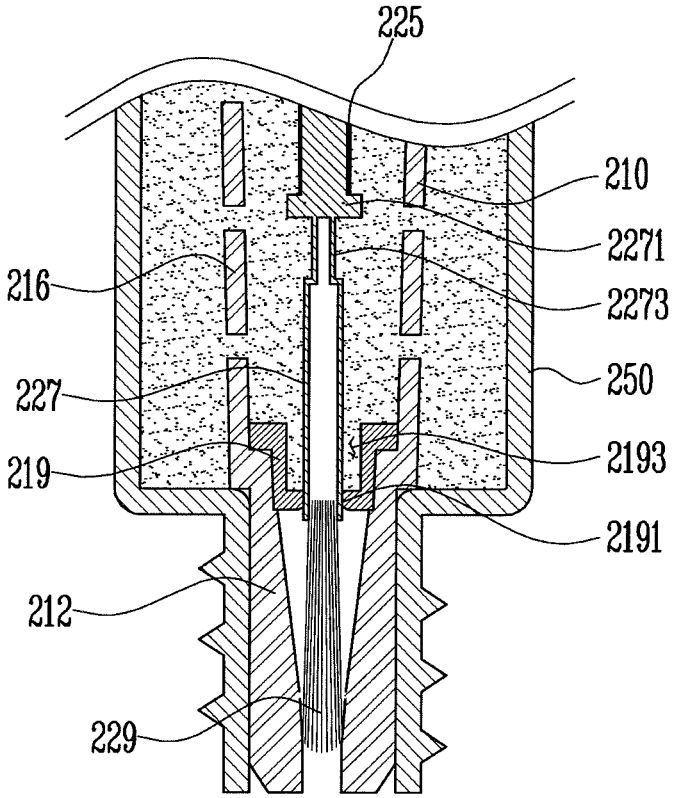
FIG. 12 is a cross-sectional view of a part of a front end of a cosmetic container according to another exemplary embodiment of the present invention.

FIG. 12 is a cross-sectional view of a part of the front end of the cosmetic container according to another exemplary embodiment of the present invention.

Referring to FIG. 12, an external side of the front end 212 of the rod insertion container 210 may be configured to be in close contact with an inner side of the front end 252 of the body part 250. Accordingly, the nail polish does not leak between the external side of the front end 212 of the rod insertion container 210 and the front end 252 of the body part 250. In this case, the nail polish flowing into the front end 212 of the rod insertion container 210 may flow in by the same principle as that described with reference to FIG. 7.

That is, the brush support piece 227 includes a diameter increasing part 2271 protruding from one region of the brush support piece 227 and a diameter decreasing part 2273, of which an outer diameter is decreased, in a lower region of the diameter increasing part 2271. An outer diameter of the diameter increasing part 2271 corresponds to an inner diameter of a receiving hole 2193, and the outer diameter of the diameter decreasing part 2273 is formed to be smaller than an inner diameter of the guide hole 2191. Further, an outer diameter of the brush support piece 227 passing through the guide hole 2191 corresponds to a size of the inner diameter of the guide hole 2191.

The diameter increasing part 2271 and the diameter decreasing part 2273 enter a guiding member according to a movement of the brush support piece 227 in a first direction, and the diameter decreasing part 2273 starts to leave the guide hole 2191 immediately after the diameter increasing part 2271 enters the receiving hole 2193.

In this case, a liquid material present within the receiving hole 2193 moves in the first direction D1 by the diameter increasing part 2271 and flows in a space 2121 inside a front end 212 of the rod insertion container 210 along an outer peripheral surface of the diameter decreasing part 2273.

Since the outer diameter of the brush support piece 227 is formed to correspond to a size of the inner diameter of the guide hole 2191, when the outer diameter of the brush support piece 227 passes through the guide hole 2191, nail polish present in the receiving hole 2191 is prevented from flowing into the space 2121 through a guiding member 219. Only when the diameter decreasing part 2273 passes through the guide hole 2191, the nail polish within the receiving hole 2191 flows into the space 2121. Accordingly, it is possible to adjust the amount of nail polish flowing into the space 2121 by adjusting a size of the receiving hole 2191.

Further, a cross-sectional shape of the diameter increasing part 2271 formed in the brush support piece 227 may be a quadrangular shape, not an arrow shape which is the cross-sectional shape of the diameter increasing part 1171 of FIG. 7. That is, the cross-sectional shape of the diameter increasing part 2271 may be varied. Further, an internal shape of a front end of the guiding member 219 may be formed to correspond to the cross-sectional shape of the diameter increasing part 2271 so that the diameter increasing part 2271 may be seated on the guiding member 219.

Figure 13:
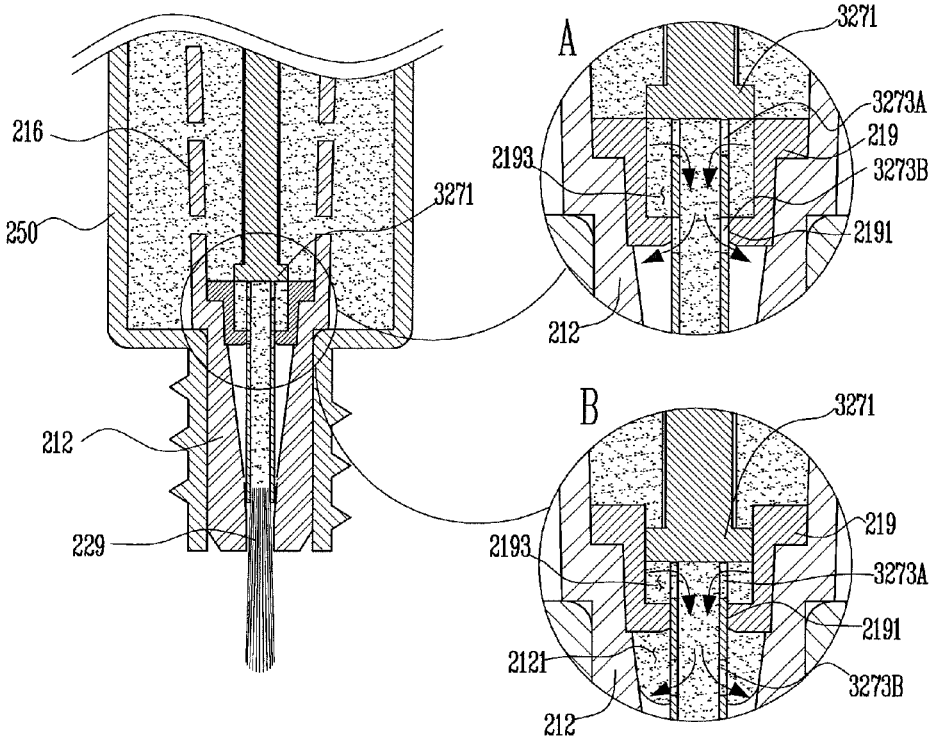
FIG. 13 is a cross-sectional view of a part of a front end of a cosmetic container according to another exemplary embodiment of the present invention.
Figure 14:
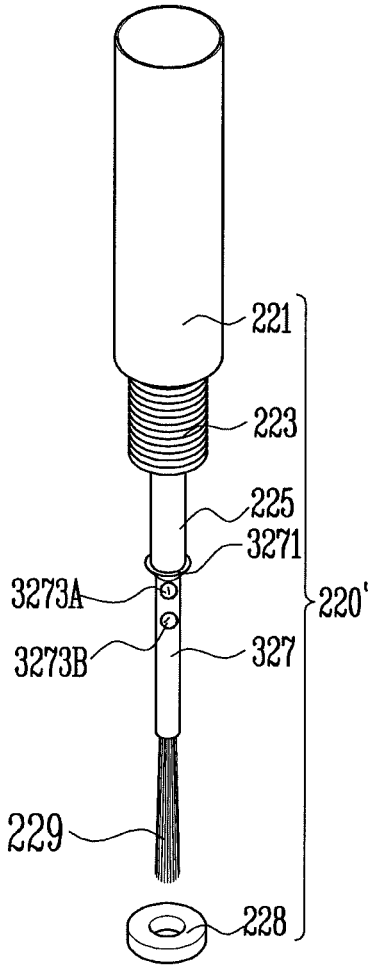
FIG. 14 is a perspective view of a brush supporting means according to another exemplary embodiment of the present invention.

FIG. 13 is a cross-sectional view of a part of a front end of a cosmetic container according to another exemplary embodiment of the present invention, and FIG. 14 is a perspective view of a brush supporting means according to another exemplary embodiment of the present invention. In the configuration illustrated in FIGS. 13 and 14, the same elements as those of the cosmetic container described with reference to FIGS. 1 to 12 are denoted by the same reference numerals, and descriptions thereof will be omitted.

Referring to FIGS. 13 and 14, a brush support piece 227 includes a diameter increasing part 3271 protruding from one region of the brush support piece 227 and one or more through-holes 3273A and 3273B formed in a lower region of the diameter increasing part 3271. An outer diameter of the diameter increasing part 3271 is formed to correspond to an inner diameter of a receiving hole 2193, and an outer diameter of the brush support piece 227 passing through a guide hole 2191 is formed to correspond to a size of an inner diameter of the guide hole 2191.

Referring to region A and region B of FIG. 13 which are enlarged views of partial regions of the guiding member and the brush support piece, the diameter increasing part 3271, the first through-hole 3273A, and the second through-hole 3273B enter the guiding member 219 according to a movement of the brush support piece 227 in the first direction D1, and the second through-hole 3273B starts to leave the guide hole 2191 immediately after the diameter increasing part 3271 enters the receiving hole 2193. In this case, a liquid material present inside the receiving hole 2193 flows into the first through-hole 3283A by pressure applied to the receiving hole 2193 when the diameter increasing part 3271 enters the guiding member 219. Nail polish present within a hollow of the brush support piece 227 starts to be discharged through the second through-hole 3273B by an inflow of the nail polish and flows into a space 2121 of a rod insertion container 216.

Figure 15:
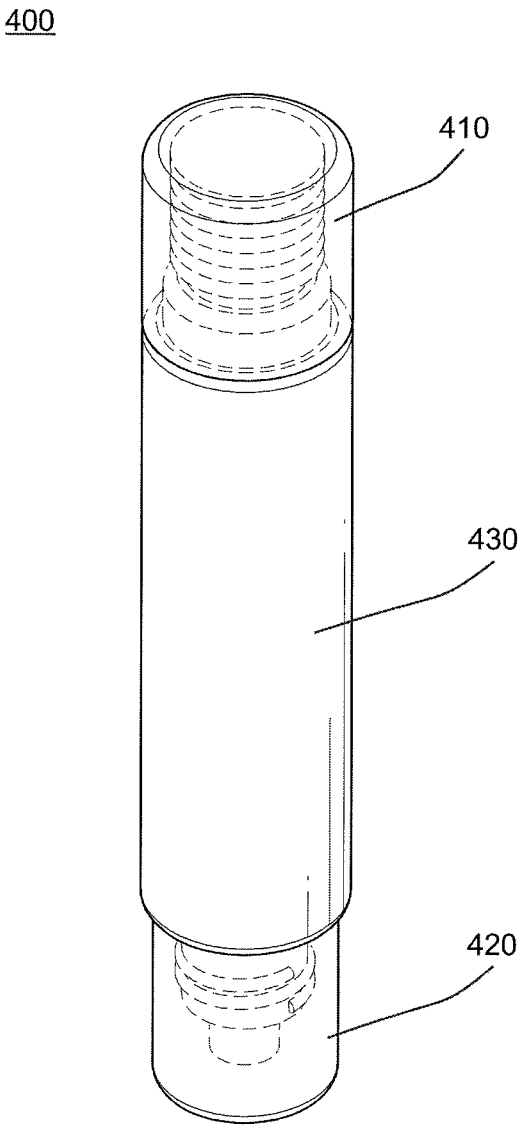
FIG. 15 is a perspective view illustrating a cosmetic container according to another exemplary embodiment of the present invention.

FIG. 15 is a perspective view of a cosmetic container according to another exemplary embodiment of the present invention.

A cosmetic container 400 according to another exemplary embodiment of the present invention generally includes a body part 430, in which a liquid material, such as nail polish, a stopper 410 provided at one side of the body part 430, and a cap 420 provided at a front end of the body part 430.

The body part 430 may be formed of a transparent material or a semitransparent material so that nail polish inside the body part 430 may be viewed, or may adopt all of glass and synthetic resin materials.

In the cap 420, a lower surface is formed to be flat as illustrated in FIG. 1, so that the cosmetic container may be stood while the cap 420 faces a lower side when the container is kept.

Figure 16A:
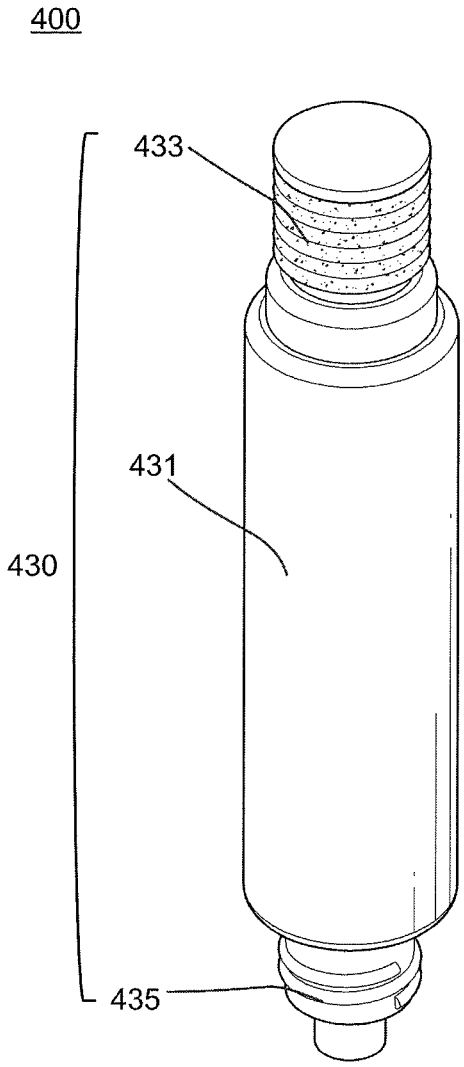
FIG. 16A is a perspective view of an operation of a cosmetic container according to an exemplary embodiment of the present invention.
Figure 16B:
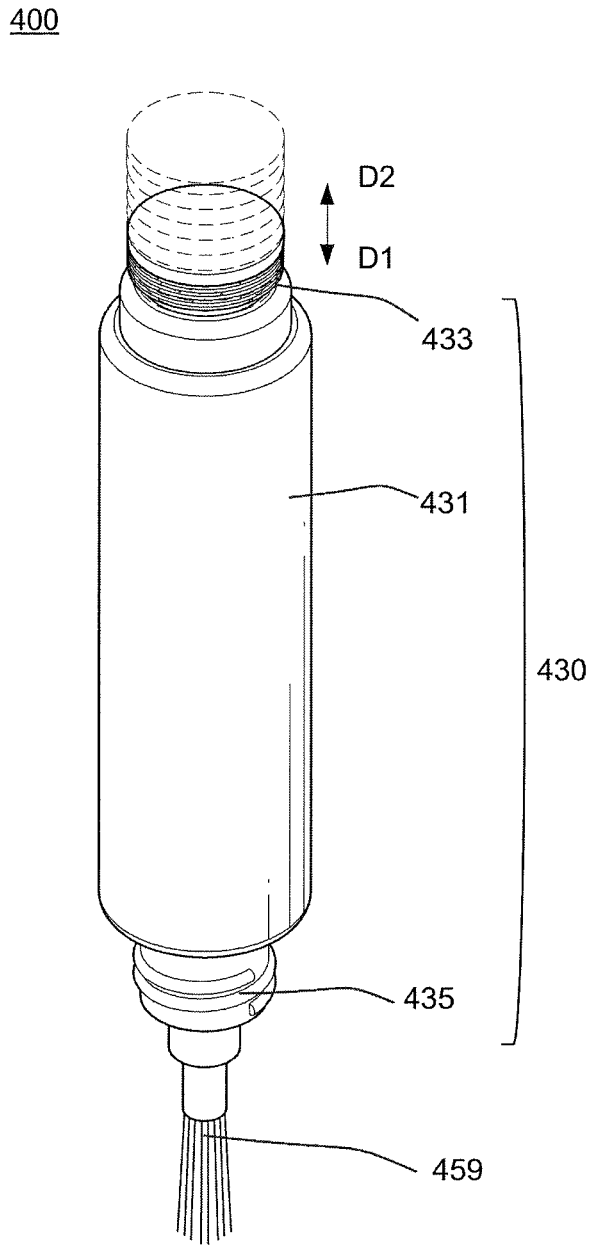
FIG. 16B is a perspective view of an operation of a cosmetic container according to an exemplary embodiment of the present invention.

FIGS. 16A and 16B are perspective views of an operation of the cosmetic container of FIG. 15.

Referring to FIGS. 16A and 16B, the body part 430 may include a main body 431, of which an inner side is extended through and in which a liquid material is stored, an extendable part 433 extensively formed at a rear end of the main body 431, and a front end 435 coupled with a cap 420.

The extendable part 433 is formed to be extensible in the first direction D1 and the second direction D2. To this end, the extendable part 433 may be formed of a flexible material. It is assumed in FIG. 2 that the extendable part 433 has a winkle shape, but various structures for an extension operation are applicable to the extendable part 433 as a matter of course.

When the extendable part 433 is contracted in the first direction D1 by external force, a brush 459 stained with nail polish protrudes to the outside, and a user may wear nail polish on a nail or a toenail by using the brush 459 stained with the nail polish.

Figure 17:
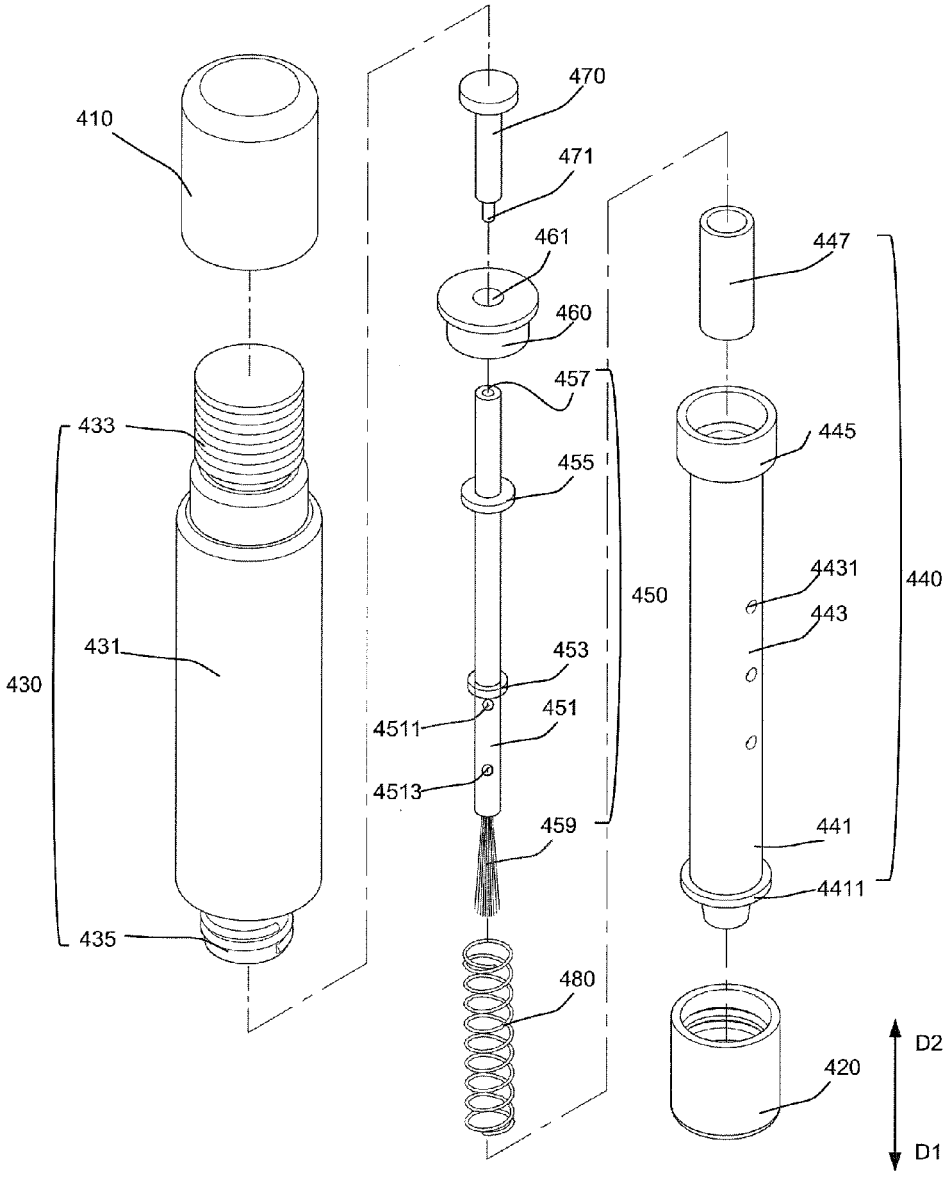
FIG. 17 is an exploded perspective view of a cosmetic container according to an exemplary embodiment of the present invention.

FIG. 17 is an exploded perspective view of the cosmetic container of FIG. 15.

Referring to FIG. 17, the cosmetic container 400 according to the exemplary embodiment of the present invention includes the body part 430, of which an inner side is extended through, and in which a liquid material is stored, and a rod insertion container 440 provided with one or more liquid inflow holes 4431, into which nail polish stored in the body part 110 flows after being inserted into the body part 430.

Further, the cosmetic container 400 includes a brush support piece 450 inserted into the rod insertion container 440. The brush support piece 450 may be provided with a brush 459 at a front end 451, and may include a diameter increasing part 452 protruding from one region of the brush support piece 450 and a protrusion 455 protruding from one region of the brush support piece 450. In this case, the protrusion 455 may be formed at an upper side of the diameter increasing part 452. Further, the protrusion 455 may protrude to be larger than a diameter of the diameter increasing part 453.

Further, the cosmetic container 400 includes a sealing stopper 460 inserted into a rear end 145 of the rod insertion container 440 after the brush support piece 450 is inserted into the rear end of the rod insertion container 440 to seat the rod insertion container 440. The sealing stopper 460 is provided with a through-hole 461.

A pressing member 470, which moves in the first direction D1 and the second direction D2 by a movement of the extendable part 433, may be inserted into the through-hole 461 of the sealing stopper 460, and a distal end 171 of the pressing member 470 may be inserted and fixed to the fixing hole 457 formed at the rear end of the brush support piece 450.

In the meantime, the cap 420 is coupled with the front end 435 of the body part 430, so that a front end 441 of the 440, which is a position where the brush 459 is immersed into the nail polish, is prevent from external air.

Further, the stopper 410 is coupled to the extendable part 433 of the body part 430, so that the stopper 410 may be coupled to the extendable part 433 so as to prevent the brush 459 from being drawn out from the rod insertion container 440 and damaged by undesired external force when a user does not wear nail polish.

Figure 18:
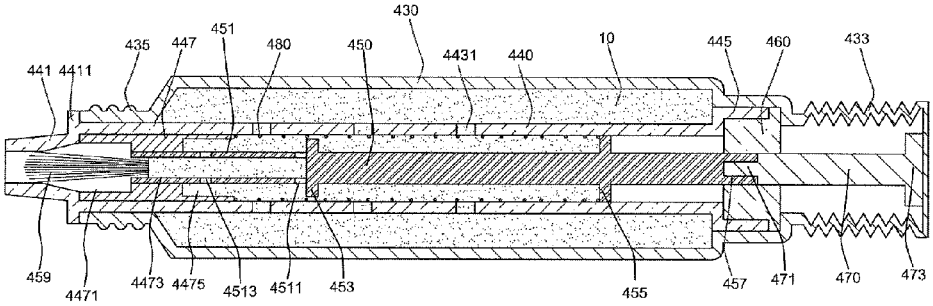
FIG. 18 is a cross-sectional view of the cosmetic container according to the exemplary embodiment of the present invention.
Figure 19:
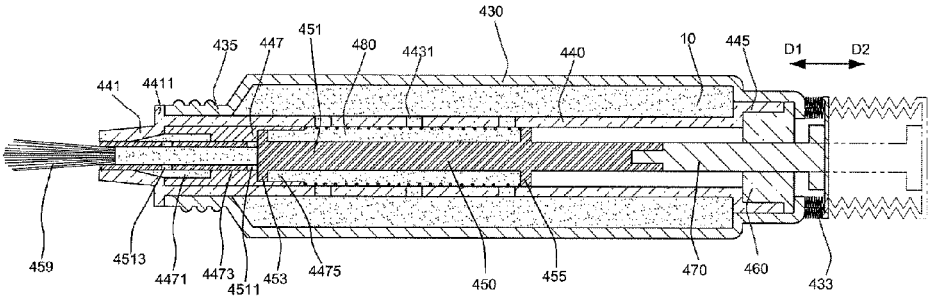
FIG. 19 is a cross-sectional view of the cosmetic container according to the exemplary embodiment of the present invention.

FIGS. 18 and 19 are cross-sectional views of the cosmetic container of FIG. 15. In this case, FIG. 18 is a cross-sectional view of the case where the brush is accommodated inside the container, and FIG. 19 is a cross-sectional view of the case where the brush protrudes to the outside of the container. Hereinafter, an operation of the cosmetic container 400 according to the exemplary embodiment of the present invention will be described in more detail.

A support part 4411 protruding to the outside is formed in one region of the front end 441 of the rod insertion container 440, the rod insertion container 440 is inserted through the front end 435 of the body part 430, and the support part 4411 is supported by a distal end of the front end 435 of the body part 430.

The front end 4411 under the support part 4411 of the rod insertion container 440 is in external contact with the front end 435 of the body part 430.

An elastic member 480 is accommodated in the rod insertion container, and is laid along an outer peripheral surface of at least a part of the brush support piece 450. Herein, one end of the elastic member 480 may be supported by the protrusion 455, and the other end of the elastic member 480 may be supported by a distal end of the guiding member 447.

It is illustrated in FIG. 17 that the protruding part 455 protrudes in a ring shape, but the protruding part 455 may protrude in various forms, and a separate ring-shaped member may be inserted into and fixed to the brush support piece 450 to support one end of the elastic member 480.

The pressing member 470 is accommodated inside the extendable part 433, and one surface 473 of the pressing member 470 is in close contact with one surface of an inner side of the extendable part 433. Accordingly, when external force is applied to the extendable part 433 in the first direction D1, the pressing member 470 and the brush support piece 450 coupled with one end of the pressing member 470 move in the first direction D1. In this case, the brush 459 mounted at the front end 451 of the brush support piece 450 moves to the outside of the body part 430, and when the external force is removed, the elastic member 480 moves the brush support piece 450 in the second direction, so that the brush 459 is accommodated in the body part 430.

In this case, a pressure within the rod insertion container 440 may be increased according to an extension operation of the extendable part 433, and according to the exemplary embodiment of the present invention, the nail polish 10 communicate with inside and outside the rod insertion container 440 through the plurality of liquid inflow holes 4431 formed in the rod insertion container 440, so that a general pressure may be constantly maintained within the body part 430.

Further, whenever the user extends the extendable part 433 by pressing the extendable part 433, the nail polish 10 within the body part 430 is evenly mixed, thereby preventing the nail polish 10 from being hardened.

The guiding member 447 is inserted into and fixed to the front end 441 of the rod insertion container 440, includes a first receiving hole 4471 having a space in which the brush 459 is accommodated, a guide hole 4473 extended from the first receiving hole 4471, and guiding a movement of the brush support piece 450 in the first direction D1 and the second direction D2, and a second receiving hole 4475 extended from the guide hole 4473, and having a larger inner diameter than an inner diameter of the guide hole 4473 to receive the nail polish 10.

Figure 20A:
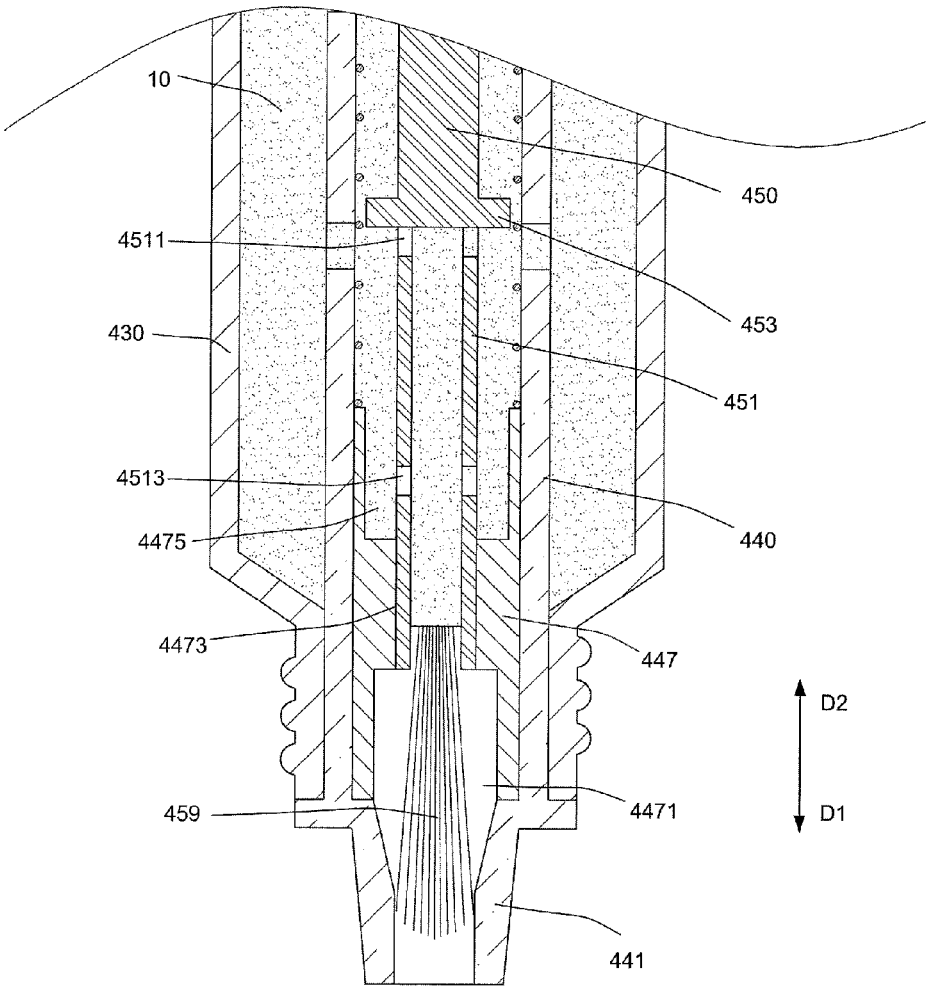
FIG. 20A is a diagram schematically illustrating a flow of nail polish within the cosmetic container when a brush faces downwardly according to an exemplary embodiment of the present invention.
Figure 20B:
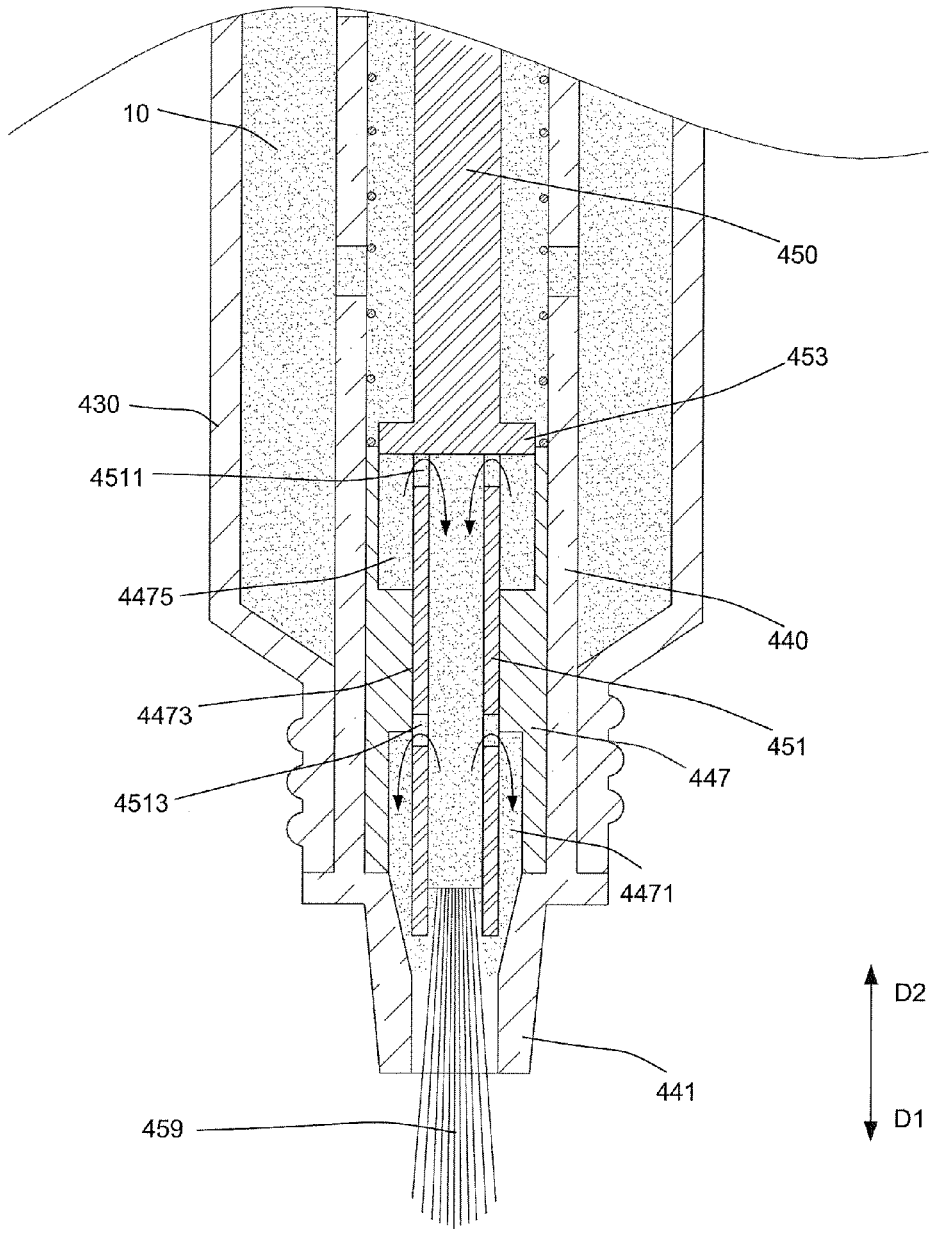
FIG. 20B is a diagram schematically illustrating a flow of nail polish within the cosmetic container when a brush faces downwardly according to an exemplary embodiment of the present invention.
Figure 20C:
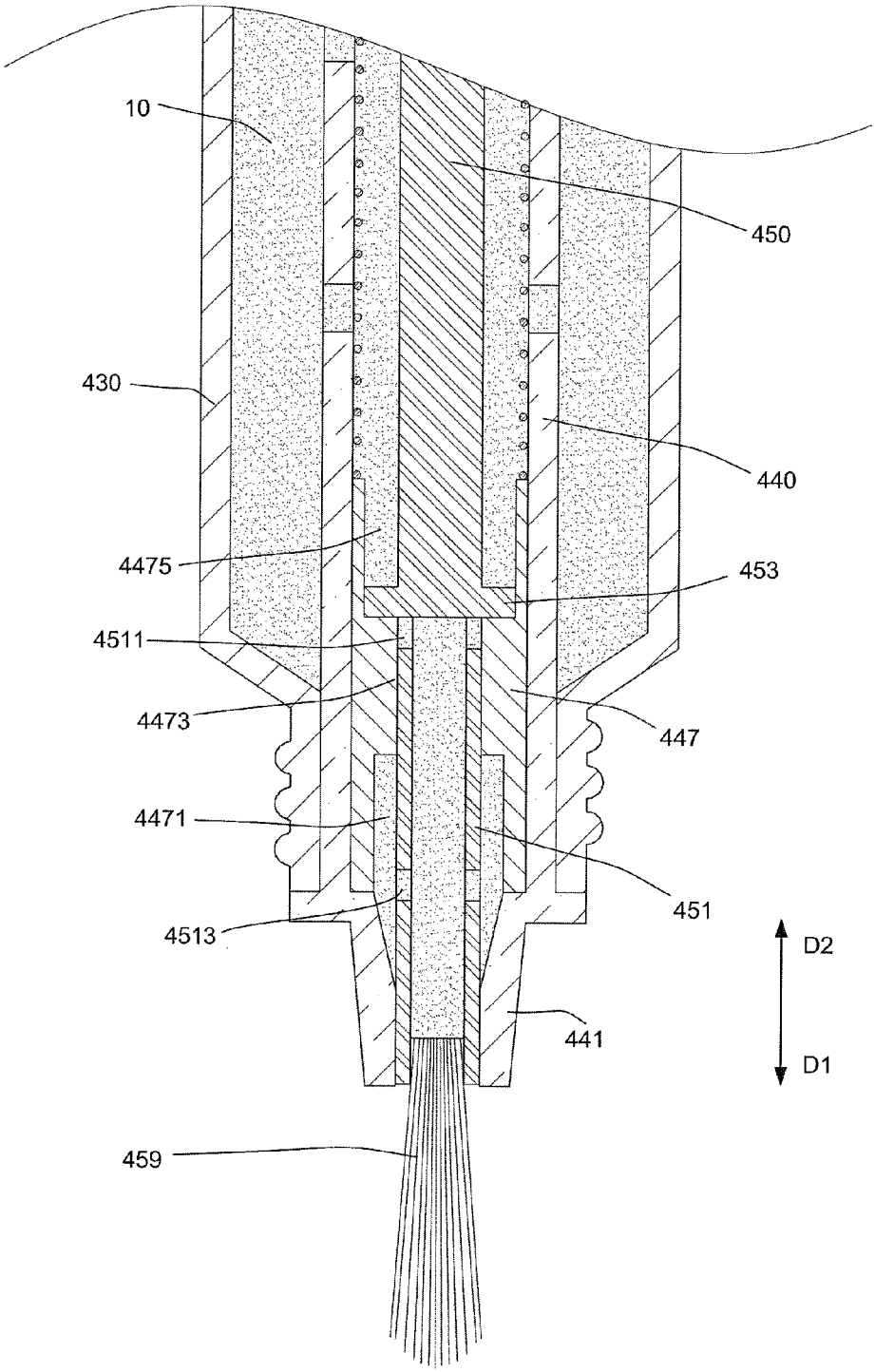
FIG. 20C is a diagram schematically illustrating a flow of nail polish within the cosmetic container when a brush faces downwardly according to an exemplary embodiment of the present invention.

FIGS. 20A to 20C are diagrams schematically illustrating a flow (arrow) of nail polish within the cosmetic container when the brush faces downwardly according to an exemplary embodiment of the present invention.

First, referring to FIG. 20A, the brush support piece 450 is movable in the first direction and the second direction in the state where the front end 451 of the brush support piece 450 is inserted into the guiding member 447.

In this case, the guiding member 447 may guide a sliding movement of the front end 451 of the brush support piece 450 in the state of being fixed to the front end 441 of the rod insertion container 440. The brush support piece 450 is movable by the operations of the extendable part 433 and the pressing member 470, which has been described above.

Further, the brush support piece 450 may be provided with the diameter increasing part 453 protruding from one region of the brush support piece 450. More particularly, as illustrated in FIGS. 20B and 20C, the diameter increasing part 453 moves together according to a movement of the brush support piece 450 in the first direction D1 to make the nail polish present in the second receiving hole 4475 of the guiding member 447 flow into the space formed within the first receiving hole 4471 and the front end 441 of the rod insertion container 440.

To this end, an outer diameter of the diameter increasing part 453 is formed to correspond to a size of an inner diameter of the second receiving hole 4475 formed in the guiding member 447, and an outer diameter of the front end 451 of the brush support piece 450 passing through the guide hole 4473 is formed to correspond to a size of an inner diameter of the guide hole 4473.

That is, the diameter increasing part 453 pushes the nail polish 10 present in the second receiving hole 4475 in the first direction D1 in the state of being in close contact with an inner side of the second receiving hole 4475, and makes the nail polish 10 flow into the first receiving hole 4471.

Further, one or more through-holes 4511 and 4513 may be formed in a lower region of the diameter increasing part 453 so that the nail polish 10 present inside the second receiving hole 4475 may flow into the first receiving hole 4471 from a time at which the diameter increasing part 453 enters the second receiving hole 4475.

Referring to FIGS. 20B and 20C, the diameter increasing part 453, a first through-hole 4511, and a second through-hole 4513 enter the guiding member 447 according to a movement of the brush support piece 450 in the first direction D1, and the second through-hole 4513 starts to leave the second through-hole 4513 after the diameter increasing part 453 starts to enter the receiving hole 4475. In this case, the liquid material 10 present inside the second receiving hole 4475 flows into the first through-hole 4511 by pressure applied to the second receiving hole 4475 when the diameter increasing part 453 enters the guiding member 447.

The nail polish 10 present within the hollow of the front end 451 of the brush support piece starts to be discharged through the second through-hole 4513 by the inflow of the nail polish 10 to flow into the space, in which the brush 459 is seated, formed by the first receiving hole 4471 of the guiding member 447 and the front end 441 of the rod insertion container 440.

By the aforementioned structure, when the user presses the extendable part 433 of the body part 430 for wearing the nail polish, the nail polish 10 present inside the rod insertion container 440 may be stably charged in the space within the front end 441 and the first receiving hole 4471, and the brush 459, from which the nail polish is removed after manicuring returns to the space within the front end 441 and the first receiving hole 4471 again to be immersed into the charged nail polish.

Further, when the presses the pressing member 433 for wearing the nail polish and the amount of nail polish stained on the brush 459 is small, the user may press the pressing member 433 one more time, and in this case, as described above, the diameter increasing part 453 and the first and second through-holes 4511 and 4513 may make the nail polish 10 present in the second receiving hole 4475 additionally flow into the first receiving hole 4471, so that the brush 459 may be sufficiently stained with the nail polish.

Figure 21A:
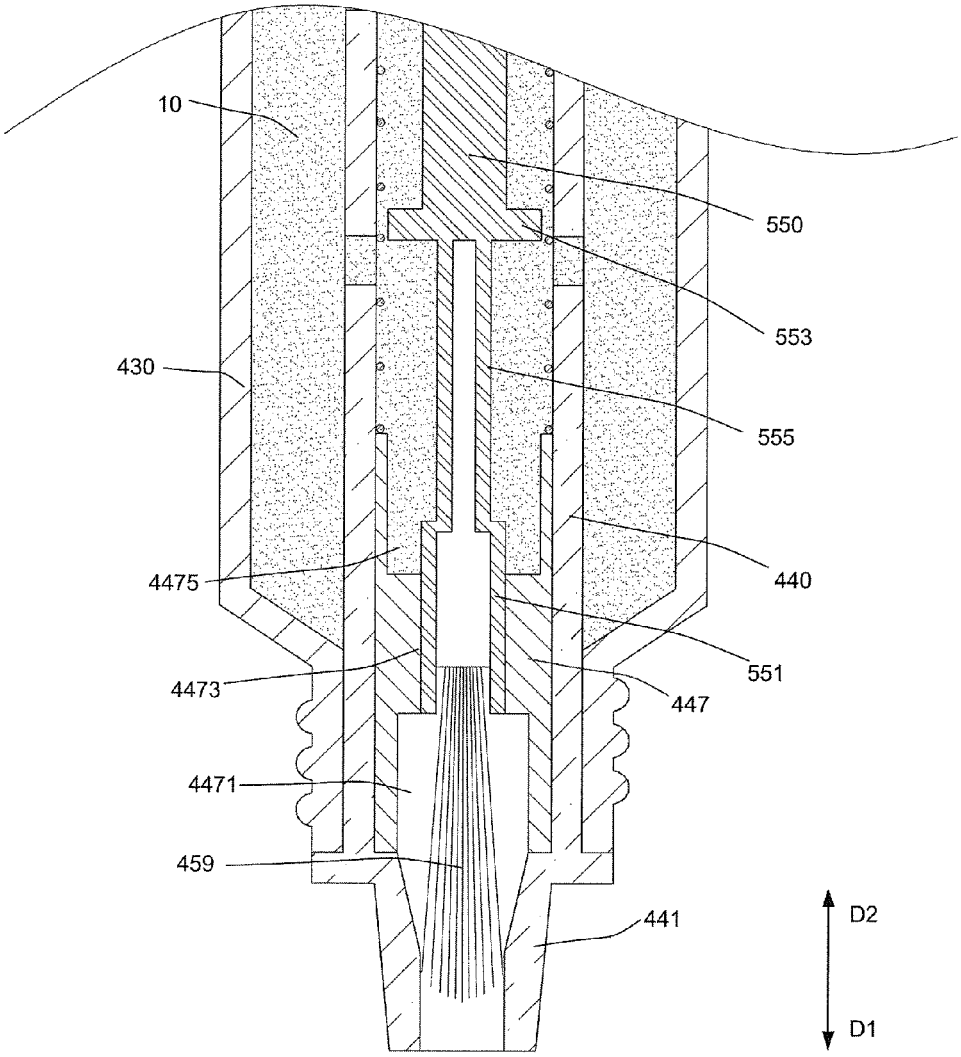
FIG. 21A is a diagram schematically illustrating a flow of nail polish within a cosmetic container when a brush faces downwardly according to another exemplary embodiment of the present invention.

FIGS. 21A to 12C are diagrams schematically illustrating a process of an inflow of nail polish to a front end of a rod insertion container according to another exemplary embodiment of the present invention.

Figure 21B:
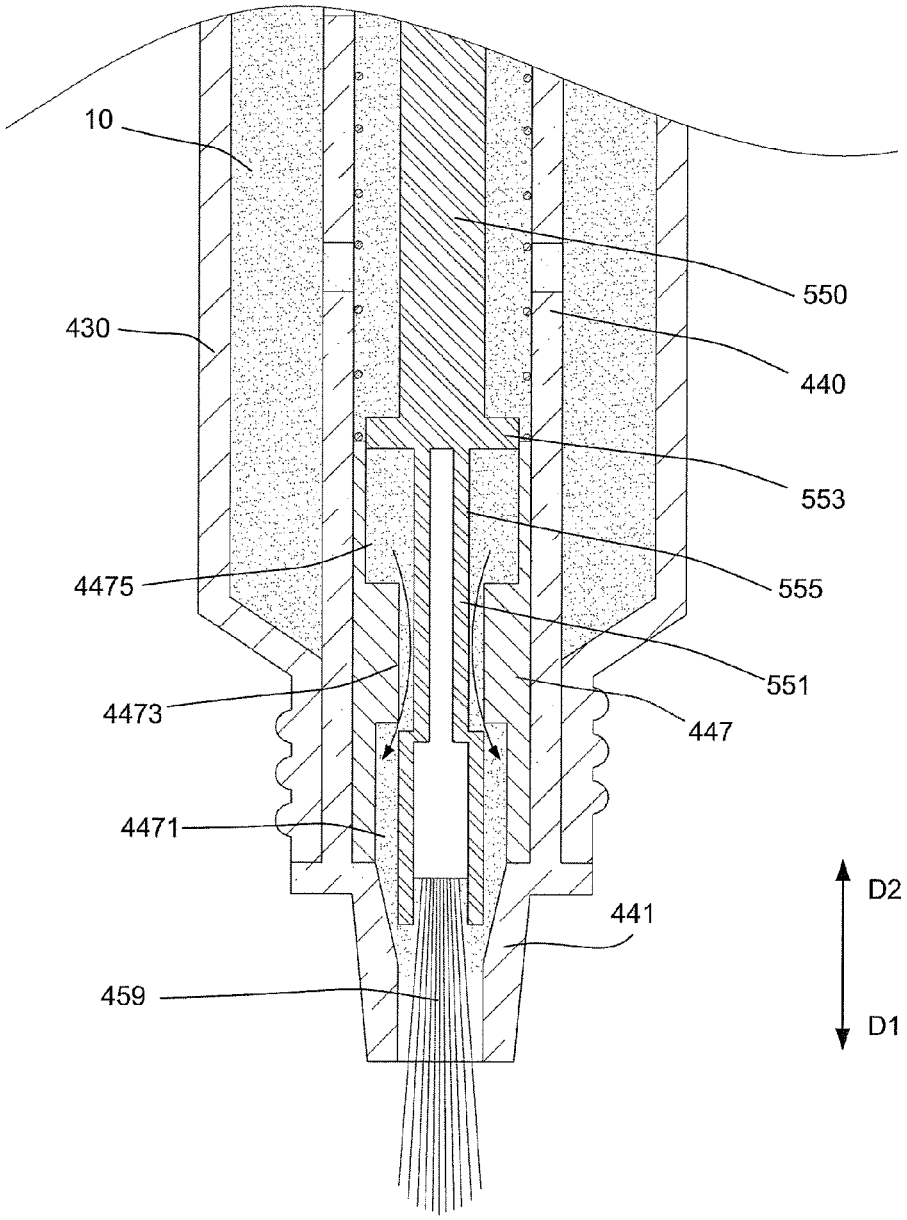
FIG. 21B is a diagram schematically illustrating a flow of nail polish within a cosmetic container when a brush faces downwardly according to another exemplary embodiment of the present invention.
Figure 21C:
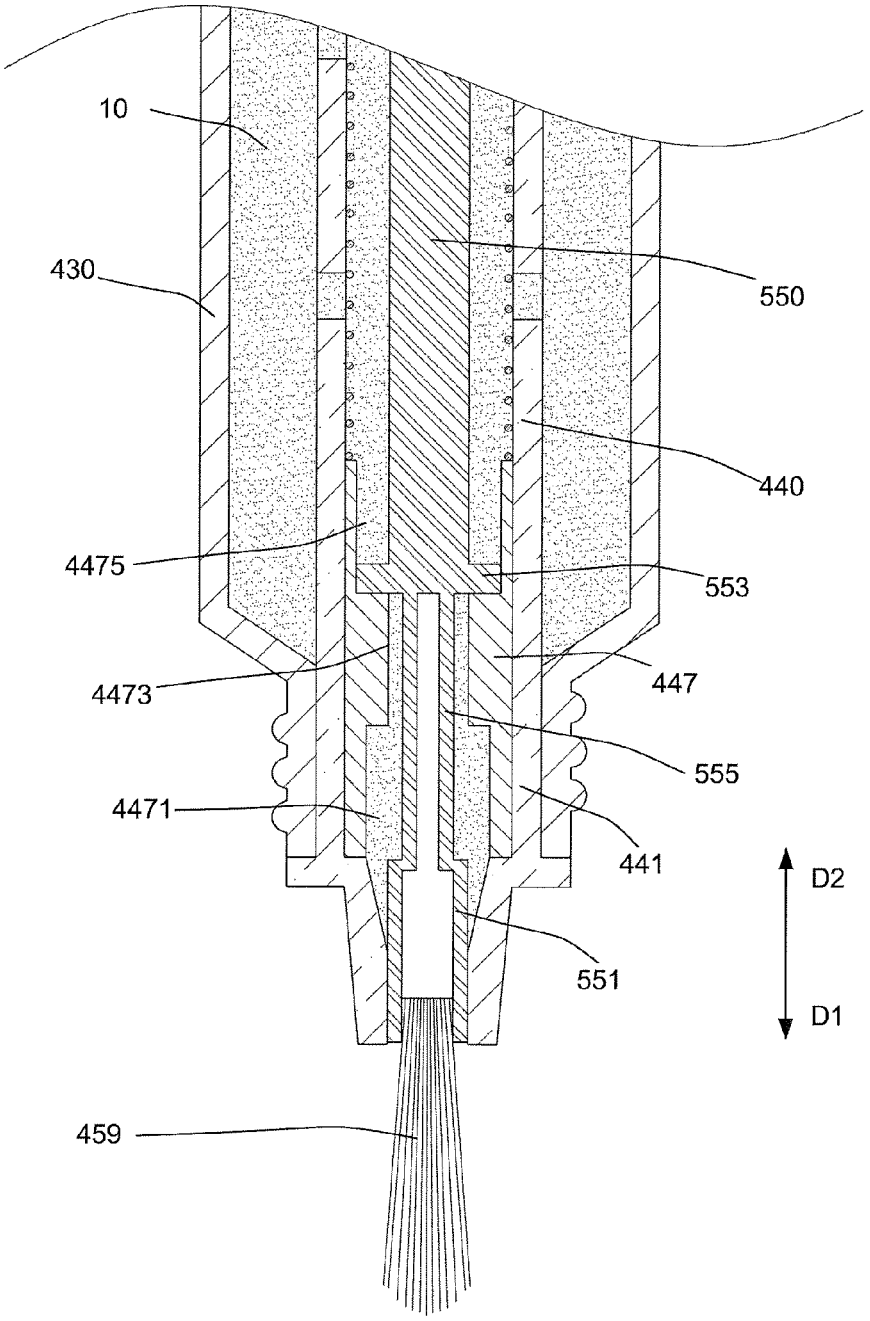
FIG. 21 C is a diagram schematically illustrating a flow of nail polish within a cosmetic container when a brush faces downwardly according to another exemplary embodiment of the present invention.

In the configuration illustrated in FIGS. 21A to 21C, the same elements as those of the cosmetic container described with reference to FIGS. 15 to 20 are denoted by the same reference numerals, and descriptions thereof will be omitted. In FIG. 21, some configurations of a rod insertion container among the aforementioned configurations of the cosmetic container are differently implemented, and the different configurations will be mainly described.

A brush support piece 550 may be provided with a diameter increasing part 553 protruding from one region of the brush support piece 550. More particularly, as illustrated in FIGS. 21B and 21C, the diameter increasing part 553 moves together according to a movement of the brush support piece 550 in a first direction D1 to make nail polish 10 present in a second receiving hole 4475 of a guiding member 447 flow into a space within a first receiving hole 4471.

To this end, an outer diameter of the diameter increasing part 553 may correspond to an inner diameter of a second receiving hole 4475 formed in the guiding member 447. That is, the diameter increasing part 553 pushes the nail polish 10 present in the second receiving hole 4475 in the first direction D1 in the state of being in close contact with the second receiving hole 4475, and makes the nail polish 10 flow into the first receiving hole 4471.

Further, a diameter decreasing part 555, of which an outer diameter is decreased, is formed in a lower region of the diameter increasing part 553, so that the nail polish 10 present inside the second receiving hole 4475 may flow into the first receiving hole 4471 from a time at which the diameter increasing part 553 enters the second receiving hole 4475. The diameter decreasing part 555 may be formed by decreasing the outer diameter of a brush support piece 551 of the brush support piece 550 or cutting a recess in the front end 551 of the brush support piece 551. The outer diameter of the diameter decreasing part 555 is formed to be smaller than an inner diameter of a guide hole 447 formed in a guiding member 447.

A predetermined section, in which the diameter decreasing part 555 is formed on the front end 551 of the brush support piece 550 may be formed at a section in which the diameter decreasing part 555 gets out of the guide hole 4473 when the diameter increasing part 553 enters the second receiving hole 4475 as illustrated in FIG. 7B.

That is, when the diameter increasing part 553 enters the second receiving hole 4475, the diameter decreasing part 455 also enters inside the first receiving hole 4471. In this case, the nail polish 10 present in the second receiving hole 4475 may move in the first direction D1 by the diameter increasing part 553 and flow into a space formed by the first receiving hole 4471 along an outer peripheral surface of the diameter decreasing part 555.

In the related art, when a user wears nail polish, the user generally puts a bottle beside the user, so that there is a danger in that the bottle is fallen by carelessness, and a flaw may be generated in undried nail polish during a process of putting a brush into the bottle and turning a stopper after use of the bottle, so that there is a convenience in that the user needs to wear nail polish again.

Further, since a thinner component is contained in the nail polish, there is always a problem in that unless a stopper is completely covered, the nail polish is easily volatilized due to strong volatility that is a characteristic of nail polish, and nail polish within a container is hardened or spoiled, thereby losing a function as a product.

However, according to the present invention, a user may wear nail polish on a desired position by taking out the brush, which has been immersed into the nail polish present in the front end of the rod insertion container from the rod insertion container by pressing the pressing member, and close the cap and keep the cosmetic container after the use of the nail polish, and prevent external force to be transmitted to the brush by separating the pressing member from the push stick so as to prevent the brush from being drawn out and damaged by undesired external force. Further, the pressing member is accommodated in the main body while the user wears the nail polish, thereby achieving esthetic sensibility. Further, the cosmetic container according to the present invention has a shape, by which the cosmetic container may be kept by closing the cap after the use thereof is completed, so that the cosmetic container is a product having a function of protecting the brush and an excellent design element.

Further, even though the extension operation of the brush support means is repeated within the rod insertion container, liquid is prevented from leaking to the outside of the container by evenly distributing pressure within the container, thereby improving stability of the container.

Further, it is possible to solve inconvenience in that the user needs to continuously press the pressing member while wearing nail polish by the latching member formed at the other end of the pressing member.

It will be appreciated by those skilled in the art that the present invention described above may be implemented into other specific forms without departing from the technical spirit thereof or essential characteristics. Thus, it is to be appreciated that embodiments described above are intended to be illustrative in every sense, and not restrictive. The scope of the present invention is represented by the claims to be described below rather than the detailed description, and it should be interpreted that all the changes or modified forms, which are derived from the meaning of the scope of the claims, the scope of the claims, and the equivalents thereto, are included in the scope of the present invention.

What is claimed is:

1. A cosmetic container, comprising:

a main body, of which an inner side is extended through and in which a liquid material is stored;

a rod insertion container inserted into the main body, and provided with one or more liquid inflow holes through which the liquid material stored in the main body flows in;

a forcibly inserting means inserted into the rod insertion container, and including a housing, a forcibly inserting means inserted into the housing, and a push stick coupled with the pressing member and protruding from a front end of the housing;

a brush supporting means including a housing accommodating part for accommodating the housing, an extendable part extended from the housing accommodating part so that the push stick is inserted into the extendable part, and formed to be extendable according to reciprocation of the push stick, a connection part extended from the extendable part, and a brush support piece, of which a part is inserted into the connection part, and on which a brush is mounted;

an elastic member accommodated in the rod insertion container, and laid on at least a part of an outer peripheral surface of the brush support piece to restore the brush support piece, which has moved in a first direction outside the main body, in a second direction opposite to the first direction; and a cap coupled with the main body.

2. The cosmetic container of claim 1, wherein a container stopper provided with a first fastening part on an outer peripheral surface of the container stopper is formed at a rear end of the rod insertion container, and a second fastening part fastened with the first fastening part is formed inside a rear end of the main body, and a recess is formed at an external side of the first fastening part in a longitudinal direction of the rod insertion container, or a through-hole is formed inside the first fastening part.

3. The cosmetic container of claim 1, further comprising:

a container stopper coupled to a rear end of the main body.

4. The cosmetic container of claim 2, wherein the container stopper is provided with a through-hole, and the housing accommodating part is inserted into the through-hole by a forcibly fitting method in a state where the housing is accommodated in the housing accommodating part, and one or more protrusions for a close contact between the housing and the housing accommodating part are formed on an outer peripheral surface of the housing.

5. The cosmetic container of claim 1, wherein a front end of the rod insertion container is accommodated in a front end of the main body, the front end of the rod insertion container includes a space, in which the brush is accommodated, therein, and an external side of the front end of the rod insertion container is in close contact with an inner side of the front end of the main body.

6. The cosmetic container of claim 5, wherein the front end of the rod insertion container is provided with one or more first through-holes through which the liquid material present in the main body flows into the space.

7. The cosmetic container of claim 6, wherein a start part of the front end of the rod insertion container and an external side of a center part provided with the first through-hole are formed to be spaced apart from an inner side of the front end of the main body, and an external side of a distal part of the front end of the rod insertion container is formed to be in close contact with an inner side of the front end of the main body.

8. The cosmetic container of claim 6, wherein a recess extended from the first through-hole in the second direction is formed on an outer peripheral surface of a center part of the front end of the rod insertion container, and the liquid material present in the main body flows along the recess and flows into the first through-hole, and the recess is extended in the second direction, in such a manner that the recess is extended in the second direction through a bent part extended in the first direction.

9. The cosmetic container of claim 5, further comprising:

a guiding member fixed to and inserted into a start part of the front end of the rod insertion container, and including a guide hole for guiding a movement of the brush support piece in the first and second directions, and a receiving hole extended in the second direction and having a larger inner diameter than an inner diameter of the guide hole.

10. The cosmetic container of claim 9, wherein the brush support piece includes a diameter increasing part protruding from one region of the brush support piece and a diameter decreasing part, of which an outer diameter is decreased, in a lower region of the diameter increasing part, the liquid material present in the receiving hole moves in the first direction by the diameter increasing part, and flows into the space of the rod insertion container along an outer peripheral surface of the diameter decreasing part, an outer diameter of the diameter increasing part corresponds to an inner diameter of the receiving hole, and the outer diameter of the diameter decreasing part is smaller than an inner diameter of the guide hole, and the diameter increasing part and the diameter decreasing part enter the guiding member according to a movement of the brush support piece in the first direction, and the diameter decreasing part starts to leave the guide hole after the diameter increasing part starts to enter the receiving hole.

11. The cosmetic container of claim 9, wherein the brush support piece includes a diameter increasing part protruding from one region of the brush support piece and one or more through-holes formed in a lower region of the diameter increasing part, the through-holes include a first through-hole and a second through-hole, the diameter increasing part, the first through-hole, and the second through-hole enter the guiding member according to the movement of the brush support piece in the first direction, and the second through-hole starts to leave the guide hole after the diameter increasing part starts to enter the receiving hole, and the liquid material present within the receiving hole flows into the first through-hole when the diameter increasing part enters the guiding member, and begins to be discharged through the second through-hole to flow into the space of the rod insertion container.

12. The cosmetic container of claim 1, wherein a front end of the push stick is in contact with a rear end of the brush support piece, a rear end of the push stick and one end of the pressing member are coupled by a screwing method, and the rear end of the push stick and one end of the pressing member are separated at an unlock position, and the rear end of the push stick and one end of the pressing member are coupled at a lock position, and the push stick moves in the first direction by external force applied to the pressing member at the lock position to move the brush provided at the front end of the brush support piece to an external side of the main body.

13. The cosmetic container of claim 1, wherein a shape of a cross-section of a center part of the push stick and a shape of a cross-section of a hole provided at the front end of the housing, through which the center part of the push stick passes through, are a polygonal or elliptical shape, and the center part of the push stick includes a protruding region protruding from one region, and the push stick is not reversely deviated from the housing after an external surface of the protruding region is inserted into the hole provided at the front end of the housing by a forcibly fitting method.

14. The cosmetic container of claim 13, wherein the external surface of the protruding region and an internal surface of the hole are tapered in a direction in which the protruding region is inserted into the hole.

15. The cosmetic container of claim 3, wherein a latching member slidably formed in a direction crossing the first direction is coupled to the other end of the pressing member, and the latching member moves in the direction crossing the first direction at a position where the pressing member is completely moved in the first direction, and restricts the pressing member from moving in the second direction in a state where one end of the latching member is latched to a border of the container stopper.

16. The cosmetic container of claim 1, wherein the pressing member further includes:

a protrusion protruding from the other end of the pressing member; and a ring-shaped recess formed between the protrusion and the other end of the pressing member.

17. A cosmetic container, comprising:

a body part including a main body, of which an inner side is extended through, and in which a liquid material is stored, and an extendable part extendably formed at a rear end of the main body;

a rod insertion container inserted into the body part, and provided with one or more liquid inflow holes through which the liquid material stored in the body part flows in;

a brush support piece inserted into the rod insertion container, and mounted with a brush at a front end thereof;

a pressing member coupled with a rear end of the brush support piece and accommodated inside the extendable part;

an elastic member accommodated in the rod insertion container, and laid along at least a part of an outer peripheral surface of the brush support piece;

a cap coupled to the front end of the body part; and a sealing stopper coupled to a rear end of the rod insertion container, and including a through-hole, wherein one end of the pressing member passes through the through-hole to be coupled with a rear end of the brush support piece, and when external force is applied to the extendable part, the pressing member moves the brush in a first direction outside the body part, and when the external force is removed, the elastic member moves the brush in a second direction opposite to the first direction.

18. The cosmetic container of claim 17, wherein a supporting part protruding to the outside is formed in one region of a front end of the rod insertion container, the rod insertion container is inserted through the front end of the body part, and the supporting part is supported by a distal end of the front end of the body part, and the cosmetic container further comprises a guiding member, which is inserted into and fixed to the front end of the rod insertion container, and includes a first receiving hole forming a space, in which the brush is accommodated, a guide hole extended from the first receiving hole and guiding a movement of the brush support piece in the first and second directions; and a second receiving hole extended from the guide hole and having a larger inner diameter than an inner diameter of the guide hole.

19. The cosmetic container of claim 18, wherein the brush support piece includes a diameter increasing part protruding from one region of the brush support piece and a first through-hole and a second through-hole formed in a lower region of the diameter increasing part, the diameter increasing part, the first through-hole, and the second through-hole enter the guiding member according to the movement of the brush support piece in the first direction, and the second through-hole starts to leave the guide hole after the diameter increasing part starts to enter the second receiving hole, and the liquid material present within the second receiving hole flows into the first through-hole when the diameter increasing part enters the guiding member, and begins to be discharged through the second through-hole to flow into the space of the rod insertion container.

20. The cosmetic container of claim 18, wherein the brush support piece includes a diameter increasing part protruding from one region of the brush support piece and a diameter decreasing part, of which an outer diameter is decreased, formed in a lower region of the diameter increasing part, and the liquid material present in the second receiving hole moves in the first direction by the diameter increasing part, and flows into the space of the rod insertion container along an outer peripheral surface of the diameter decreasing part, an outer diameter of the diameter increasing part corresponds to an inner diameter of the second receiving hole, and the outer diameter of the diameter decreasing part is smaller than an inner diameter of the guide hole, and the diameter increasing part and the diameter decreasing part enter the guiding member according to a movement of the brush support piece in the first direction, and the diameter decreasing part starts to leave the guide hole immediately after the diameter increasing part starts to enter the second receiving hole.

* * * * *